US010755662B2

(12) United States Patent
Kong et al.

(10) Patent No.: US 10,755,662 B2
(45) Date of Patent: Aug. 25, 2020

(54) DISPLAY DRIVING CIRCUIT AND OPERATING METHOD THEREOF

(71) Applicant: Samsung Electronics Co., Ltd., Suwon-si, Gyeonggi-do (KR)

(72) Inventors: Ki-ho Kong, Suwon-si (KR); Taek-su Kwon, Suwon-si (KR); Jong-hyun Kim, Seoul (KR); Jee-hwal Kim, Seoul (KR); Jun-ho Park, Yongin-si (KR); Hong-keun Yune, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 100 days.

(21) Appl. No.: 15/951,596

(22) Filed: Apr. 12, 2018

(65) Prior Publication Data

US 2018/0315390 A1 Nov. 1, 2018

(30) Foreign Application Priority Data

Apr. 28, 2017 (KR) ..... 10-2017-0055760
Dec. 8, 2017 (KR) ..... 10-2017-0168484

(51) Int. Cl.
*G09G 3/36* (2006.01)
*G09G 3/3258* (2016.01)
(Continued)

(52) U.S. Cl.
CPC ..... *G09G 3/3688* (2013.01); *G09G 3/20* (2013.01); *G09G 3/3258* (2013.01); *G09G 3/3611* (2013.01); *G09G 3/3677* (2013.01); *G09G 5/02* (2013.01); *G09G 2300/0452* (2013.01); *G09G 2300/0814* (2013.01); *G09G 2300/0819* (2013.01); *G09G 2300/0842* (2013.01); *G09G 2310/021* (2013.01); *G09G 2310/0275* (2013.01); *G09G 2310/0286* (2013.01);
(Continued)

(58) Field of Classification Search
CPC ..... G09G 3/3688; G09G 3/3677; G09G 5/02; G09G 2310/021; G09G 2310/0286; G09G 2310/0291; G09G 2330/021
See application file for complete search history.

(56) References Cited

U.S. PATENT DOCUMENTS 7,800,573 B2 9/2010 Woo et al.
8,144,100 B2 3/2012 Woo et al.
(Continued)

FOREIGN PATENT DOCUMENTS

KR 10-2011-0102679 9/2011
KR 10-2016-0069921 6/2016

*Primary Examiner* — Stephen G Sherman
(74) *Attorney, Agent, or Firm* — Harness, Dickey and Pierce, P.L.C.

(57) ABSTRACT

Disclosed are a display driving circuit and a display apparatus including the same. A display driving circuit includes a first amplifier configured to drive a first data line of a display panel based on first pixel data and a second amplifier configured to drive a second data line of the display panel based on second pixel data, wherein, when a first data difference between the first pixel data and the second pixel data is greater than or equal to a data value indicating one grayscale and is less than or equal to a first threshold value, the second amplifier is turned off, and the first amplifier is configured to drive the first data line and the second data line based on the first pixel data and the second pixel data.

16 Claims, 23 Drawing Sheets

(51) Int. Cl.
*G09G 5/02* (2006.01)
*G09G 3/20* (2006.01)

(52) U.S. Cl.
CPC ..... *G09G 2310/0291* (2013.01); *G09G 2310/0297* (2013.01); *G09G 2310/08* (2013.01); *G09G 2330/021* (2013.01)

(56) References Cited

U.S. PATENT DOCUMENTS

| | | | | |
|---|---|---|---|---|
| 9,508,276 | B2 | 11/2016 | Hirakata et al. | |
| 2006/0214898 | A1* | 9/2006 | Woo | G09G 3/3688 345/90 |
| 2011/0169808 | A1* | 7/2011 | Son | G09G 3/20 345/211 |
| 2012/0188224 | A1 | 7/2012 | Lee et al. | |
| 2014/0253532 | A1* | 9/2014 | Woo | G09G 5/00 345/212 |
| 2016/0098967 | A1 | 4/2016 | Kwon et al. | |
| 2017/0287429 | A1* | 10/2017 | Kong | G09G 3/3607 |

* cited by examiner

DISPLAY DRIVING CIRCUIT AND OPERATING METHOD THEREOF

CROSS-REFERENCE TO RELATED APPLICATION

This application claims the benefit of Korean Patent Application No. 10-2017-0055760, filed on Apr. 28, 2017, in the Korean Intellectual Property Office, and Korean Patent Application No. 10-2017-0168484, filed on Dec. 8, 2017, in the Korean Intellectual Property Office, the disclosures of each of which are incorporated herein in their entireties by reference.

BACKGROUND

Example embodiments of the inventive concepts relate to a semiconductor device. For example, at least some example embodiments relate to a display driving circuit that drives a display panel to display an image thereon, and/or a method of operating the display driving circuit.

A display apparatus includes a display panel displaying an image thereon and a display driving circuit driving the display panel. The display driving circuit receives image data from an external host and transmits an image signal corresponding to the received image data to a data line of the display panel, thereby driving the display panel. Recently, as sizes and resolutions of display apparatuses have increased, research into various technologies for reducing power consumed by display driving circuits has been conducted.

SUMMARY

Example embodiments of the inventive concepts provide a display driving circuit for reducing static power consumption, and/or a method of operating the same.

According to an example embodiment of the inventive concepts, there is provided a display driving circuit including a first amplifier configured to drive a first data line of a display panel based on first pixel data; and a second amplifier configured to drive a second data line of the display panel based on second pixel data, wherein the second amplifier is disabled and the first amplifier is enabled such that the first amplifier is configured to drive the first data line and the second data line based on the first pixel data and the second pixel data, in response to a first data difference between the first pixel data and the second pixel data being greater than or equal to a data value indicating one grayscale and the first data difference being less than or equal to a first threshold value.

According to another example embodiment of the inventive concepts, there is provided a display driving circuit including a first amplifier configured to drive a first data line of a display panel based on first pixel data; a second amplifier configured to drive a second data line of the display panel based on second pixel data; and a controller configured to, in a low-power operation mode, receive the first pixel data and the second pixel data during a first horizontal driving period, and enable a first one of the first amplifier and the second amplifier, and disable a second one of the first amplifier and the second amplifier during a second horizontal driving period, in response to a first data difference between the first pixel data and the second pixel data being greater than or equal to 1, and a horizontal threshold value being less than or equal to N, N being a positive integer.

According to another example embodiment of the inventive concepts, there is provided a method of operating a display driving circuit, the method including calculating a first data difference between first pixel data and second pixel data; and driving, by a first amplifier, a first data line and a second data line of a display panel based on the first pixel data and the second pixel data, in response to the first data difference being less than or equal to a horizontal threshold value.

BRIEF DESCRIPTION OF THE DRAWINGS

Example embodiments of the inventive concepts will be more clearly understood from the following detailed description taken in conjunction with the accompanying drawings in which.

DETAILED DESCRIPTION

Hereinafter, various example embodiments of the inventive concepts will be described with reference to the attached drawings.

A display apparatus according to one or more example embodiments of the inventive concepts may be mounted on an electronic apparatus having an image display function. Examples of the electronic apparatus may include a smartphone, a tablet personal computer (PC), a portable multimedia player (PMP), a camera, a wearable device, a television (TV), a digital video disk (DVD) player, a refrigerator, an air conditioner, an air purifier, a set-top box, various medical devices, a navigation device, a global positioning system (GPS) receiver, devices for vehicles, furniture, measuring instruments, and the like.

Figure 1:
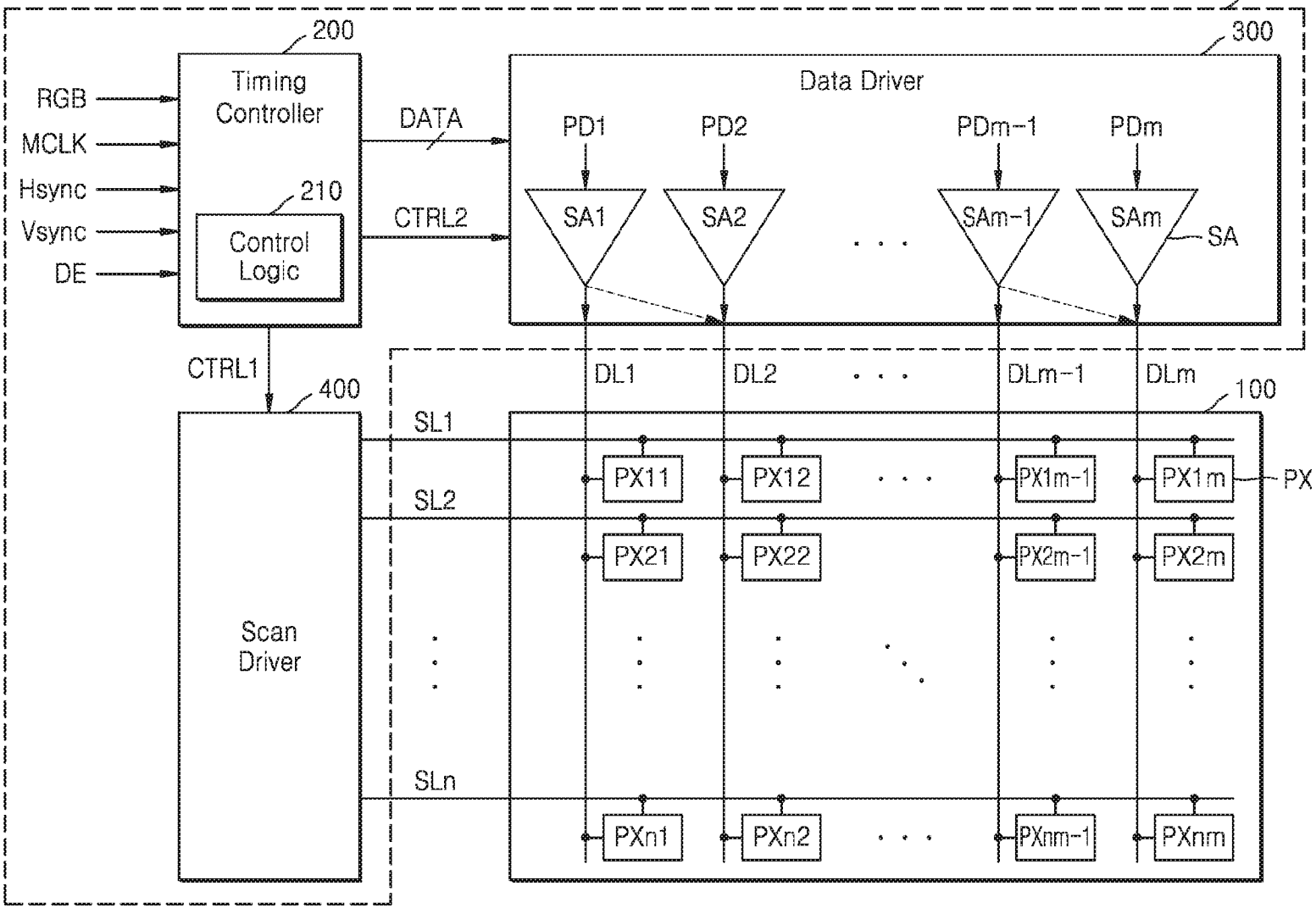
FIG. 1 is a block diagram of a display apparatus according to an example embodiment.

FIG. 1 is a block diagram of a display apparatus according to an example embodiment.

Referring to FIG. 1, a display apparatus 1000 may include a display panel 100 and a display driving circuit 500. The display driving circuit 500 may drive the display panel 100 and may include a timing controller 200, a data driver 300, and a scan driver 400.

The display panel 100 may include pixels PX arranged in a matrix and may display an image in units of frames. The display panel 100 may be implemented as one of a Liquid Crystal Display (LCD), a Light Emitting Diode (LED) display, an Organic LED (OLED) display, an Active-Matrix OLED (AMOLED) display, an Electrochromic Display (ECD), a Digital Mirror Device (DMD), an Actuated Mirror Device (AMD), a Grating Light Valve (GLV), a Plasma Display Panel (PDP), an Electro Luminescent Display (ELD), and a Vacuum Fluorescent Display (VFD), or may be implemented as another type of a flat panel display or a flexible display. For convenience of explanation, the display panel 100 is described as an OLED panel. However, example embodiments are not limited thereto.

The display panel 100 includes scan lines SL1 to SLn (or referred to as gate lines) arranged in a row direction, data lines DL1 to DLm arranged in a column direction, and the pixels PX at intersections of the scan lines SL1 to SLn and the data lines DL1 to DLm. In this case, some adjacent pixels PX, which are connected to the same scan line and have different colors, may form a unit pixel, and each of the adjacent pixels PX may be referred to as a sub-pixel.

The display panel 100 includes horizontal lines (or rows), and one horizontal line includes the pixels PX connected to one scan line. For example, pixels PX11 to PX1*m* of a first row which are connected to a first scan line SL1 may form a first horizontal line, and pixels PX21 to PX2*m* of a second row which are connected to a second scan line SL2 may form a second horizontal line.

Pixels PX of one horizontal line may be driven during a horizontal driving period, and pixels PX of another horizontal line may be driven during another horizontal driving period. For example, the pixels PX11 to PX1*m* of the first horizontal line may be driven during a first horizontal driving period, and the pixels PX21 to PX2*m* of the second horizontal line may be driven during a second horizontal driving period. As described above, the pixels PX of the display panel 100 may be driven during the first horizontal driving period to an nth horizontal driving period.

In response to a scan driver control signal CTRL1 provided from the timing controller 200, the scan driver 400 may provide a scan clock signal (or a gate-on signal) to the scan lines SL1 to SLn and thus may select the scan lines SL1 to SLn. According to the scan clock signal output from the scan driver 400, one of the scan lines SL1 to SLn is selected, and pixel signals (or image signals) respectively corresponding to the pixels PX are transmitted, through the data lines DL1 to DLm, to the pixels PX of a horizontal line corresponding to the selected one of the scan lines SL1 to SLn, thereby performing a display operation. According to an example embodiment, the scan lines SL1 to SLn may be sequentially or non-sequentially selected.

In response to a data driver control signal CTRL2, the data driver 300 converts image data into pixel signals that are analog signals (e.g., gray voltages respectively corresponding to first pixel data PD1 to mth pixel data PDm, or currents respectively corresponding to the gray voltages) and provides the pixel signals to the data lines DL1 to DLm, thereby driving the data lines DL1 to DLm. For example, the data driver 300 may charge the data lines DL1 to DLm based on the pixel signals. During one horizontal driving period, the data driver 300 may provide pixel signals of one line to the data lines DL1 to DLm. When a scan clock signal is provided, the pixel signals may be provided, through the data lines DL1 to DLm, to pixels PX of one horizontal line corresponding to the selected scan line.

The data driver 300 may include first to mth amplifiers SA1 to SAm, and each of the first to mth amplifiers SA1 to SAm may provide at least one corresponding data line with a pixel signal. The amplifier may be referred to as a channel amplifier or a source amplifier. According to the first pixel data PD1 to mth pixel data PDm, some of the first to mth amplifiers SA1 to SAm are turned off (e.g., disabled), and others thereof may be turned on (e.g., enabled). The amplifiers that are turned on may drive two data lines. In example embodiments of the inventive concepts, driving a data line may mean driving a pixel connected to the data line.

For example, when the data driver 300 drives the pixels PX21 to PX2*m* of the second horizontal line during the second horizontal driving period, if the first pixel data PD1 corresponding to the pixel PX21 is the same as the second pixel data PD2 corresponding to the pixel PX22 or a data difference between the first pixel data PD1 and the second pixel data PD2 is less than or equal to a first threshold value that is set in advance, one of the first and second amplifiers SA1 and SA2 is turned off, and the other thereof drives the first data line DL1 and the second data line DL2 during the second horizontal driving period and thus may drive the pixels PX21 and PX22. Since the first threshold value is compared with a data difference between two pieces of pixel data which correspond to two pixels of the same horizontal line, the first threshold value will be referred to as a horizontal threshold value.

According to an example embodiment, when the two pixel data are different from each other, and when a data difference between the two pixel data is less than or equal to a desired (or, alternatively, a preset) horizontal threshold value, one of two amplifiers, which is turned on, may coarse-drive two data lines based on one of the two pixel data and then may fine-drive one data line corresponding to the other pixel data based on the other pixel data. Thus, one amplifier may simultaneously drive two pixels respectively connected to the two data lines. For example, when the first amplifier SA1 is turned on, the first amplifier SA1 may simultaneously coarse-drive the first data line DL1 and the second data line DL2 based on the second pixel data PD2 during a first period of the second horizontal driving period and then may additionally fine-drive the first data line DL1 based on the first pixel data PD1 during a second period of the second horizontal driving period. Accordingly, the first amplifier SA1 may drive the pixels PX21 and PX22 during the second horizontal driving period.

As described above, in the display apparatus 1000 according to an example embodiment of the inventive concepts, when two pixel data are the same, and even when the two pixel data is not the same but a data difference between the two pixel data is less than or equal to the horizontal threshold value, one amplifier is turned off, and the other amplifier is turned on, thereby driving two pixels based on the two pixel data. Accordingly, a static current of the data driver 300 may be reduced.

According to an example embodiment, although the data difference between the two pixel data is less than or equal to the horizontal threshold value, when a transition amount of at least one of the two pixel data is greater than a second threshold value, two amplifiers may be turned on and may drive corresponding data lines, respectively. That is, when the data difference between the two pixel data is less than or equal to the horizontal threshold value, and when a transition amount of each of the two pixel data is less than or equal to the second threshold value, one amplifier is turned off, and the other amplifier is turned on, thereby driving two pixels based on the two pixel data.

In this case, the transition amount of the pixel data may be a data difference between the pixel data and previous pixel data. For example, when it is assumed that the first pixel data PD1 and the second pixel data PD2 respectively correspond to the pixel PX21 and the pixel PX22 of the second horizontal line which are driven during the second horizontal driving period, a transition amount of the first pixel data PD1 is a first data difference between first previous pixel data, which corresponds to the pixel PX11 of the first horizontal line, and the first pixel data PD1. Also, a transition amount of the second pixel data PD2 is a second data difference between second previous pixel data, which corresponds to the pixel PX12 of the first horizontal line, and the second pixel data PD2. Since the second threshold value is compared with the data difference between two pixel data corresponding to two pixels of different horizontal lines, the second threshold value will be referred to as a vertical threshold value.

When a data difference between the first pixel data PD1 and the second pixel data PD2 is less than or equal to the horizontal threshold value, and when the first data difference between the first pixel data PD1 and the first previous pixel data and the second data difference between the second pixel data PD2 and the second previous pixel data are less than or equal to the vertical threshold value, one of the first amplifier SA1 and the second amplifier SA2 is turned off, and the other thereof is tuned on during the second horizontal driving period, thereby driving the first data line DL1 and the second data line DL2. In other words, one of the first amplifier SA1 and the second amplifier SA2, which is turned on, may drive the pixel PX21 and the pixel PX22 during the second horizontal driving period.

Although the data difference between the first pixel data PD1 and the second pixel data PD2 is less than or equal to the horizontal threshold value, when at least one of the first data difference and the second data difference is greater than the vertical threshold value, both the first amplifier SA1 and the second amplifier SA2 are turned on during the second horizontal driving period, and thus, the first amplifier SA1 and the second amplifier SA2 may drive the first data line DL1 and the second data line DL2, respectively.

When one amplifier drives two data lines, driving load of the amplifier increases. Moreover, when two pixel data have great transition amounts, driving load of one amplifier driving two data lines excessively increases, and thus at least one of the data lines may not be charged to a target level. Therefore, a pixel signal having a target level may not be provided to a pixel. When a data difference between two pixel data is small, and when the transition amounts of the two pixel data are small, one of two amplifiers may be turned off, and the other thereof may be turned on, thus driving two data lines. Accordingly, a current consumed by the data driver 300 may decrease, and image quality of a display may be less likely to degrade.

The timing controller 200 may control operations of the display apparatus 1000 overall. For example, the timing controller 200 may receive, from an external device (e.g., a host device (not illustrated)), image data RGB and timing signals (e.g., a horizontal synchronization signal Hsync, a vertical synchronization signal Vsync, a clock signal DCLK, and a data enable signal DE) and may generate the scan driver control signal CTRL1 and the data driver control signal CTRL2 for respectively controlling the data driver 300 and the scan driver 400, based on the received image data RGB and timing signals. Also, the timing controller 200 may convert the image data RGB, which is received from the external device, into a format according to specifications of an interface with the data driver 300 and may transmit converted image data DATA to the data driver 300. For example, the converted image data DATA may include packet data.

The timing controller 200 may include the control logic 210. The control logic 210 may analyze the first to mth pixel data corresponding to pixels PX of one horizontal line and may control the operation of the data driver 300 based on an analysis result. The control logic 210 may generate a control signal for controlling the operation of the data driver 300 based on the analysis result and may provide the data driver 300 with the generated control signal as the data driver control signal CTRL2.

The control logic 210 may compare the data difference between two pixel data, which correspond to two pixels that are adjacent to each other on the same horizontal line, with the horizontal threshold value. As described above based on a comparison result, the control logic 210 may generate control signals including signals for controlling states and operations of amplifiers according to the pixel data. According to an example embodiment, the control logic 210 may consider the transition amounts of the two pixel data. As described above, the data driver 300 is driven under the control of the control logic 210 and thus may decrease current consumption without image quality degradation.

FIG. 1 illustrates that the control logic 210 is included in the timing controller 200, but one or more example embodiments of the inventive concepts are not limited thereto. The control logic 210 may be a circuit separate from the timing controller 200. In this case, the control logic 210 may provide the data driver 300 with the control signal controlling the operation of the data driver 300 as a second driver control signal that is different from the data driver control signal CTRL2 provided from the timing controller 200. In an example embodiment, the control logic 210 may be within the data driver 300.

Although not illustrated, the display apparatus 1000 may further include a voltage generator and an interface. The voltage generator may generate various voltages used by the display panel 100 and the display driving circuit 500.

The interface may communicate with an external device, e.g., a host processor, and may receive the image data RGB and the timing signals therefrom. For example, the interface may include one of a red-green-blue (RGB) interface, a central processing unit (CPU) interface, a serial interface, a mobile display digital interface (MDDI), an inter integrated circuit (I2C) interface, a serial peripheral interface (SPI), a micro controller unit (MCU) interface, a mobile industry processor interface (MIN), an embedded display port (eDP) interface, a D-subminiature (D-sub), an optical interface, or a high definition multimedia interface (HDMI). The interface may further include various serial or parallel interfaces.

In FIG. 1, the scan driver 400, the data driver 300, and the timing controller 200 are illustrated as different functional blocks. In some example embodiments, the scan driver 400, the data driver 300, and the timing controller 200 may be implemented as different semiconductor chips. However, in other example embodiments, at least two of the scan driver 400, the data driver 300, and the timing controller 200 may be implemented as one semiconductor chip. For example, the data driver 300 and the timing controller 200 may be integrated into one semiconductor chip. Also, some of the scan driver 400, the data driver 300, and the timing controller 200 may be integrated on the display panel 100. For example, the scan driver 400 may be integrated on the display panel 100.

Hereinafter, the operations of the control logic 210 and the data driver 300 of the display apparatus 1000 according to an example embodiment will be described in more detail.

Figure 2:
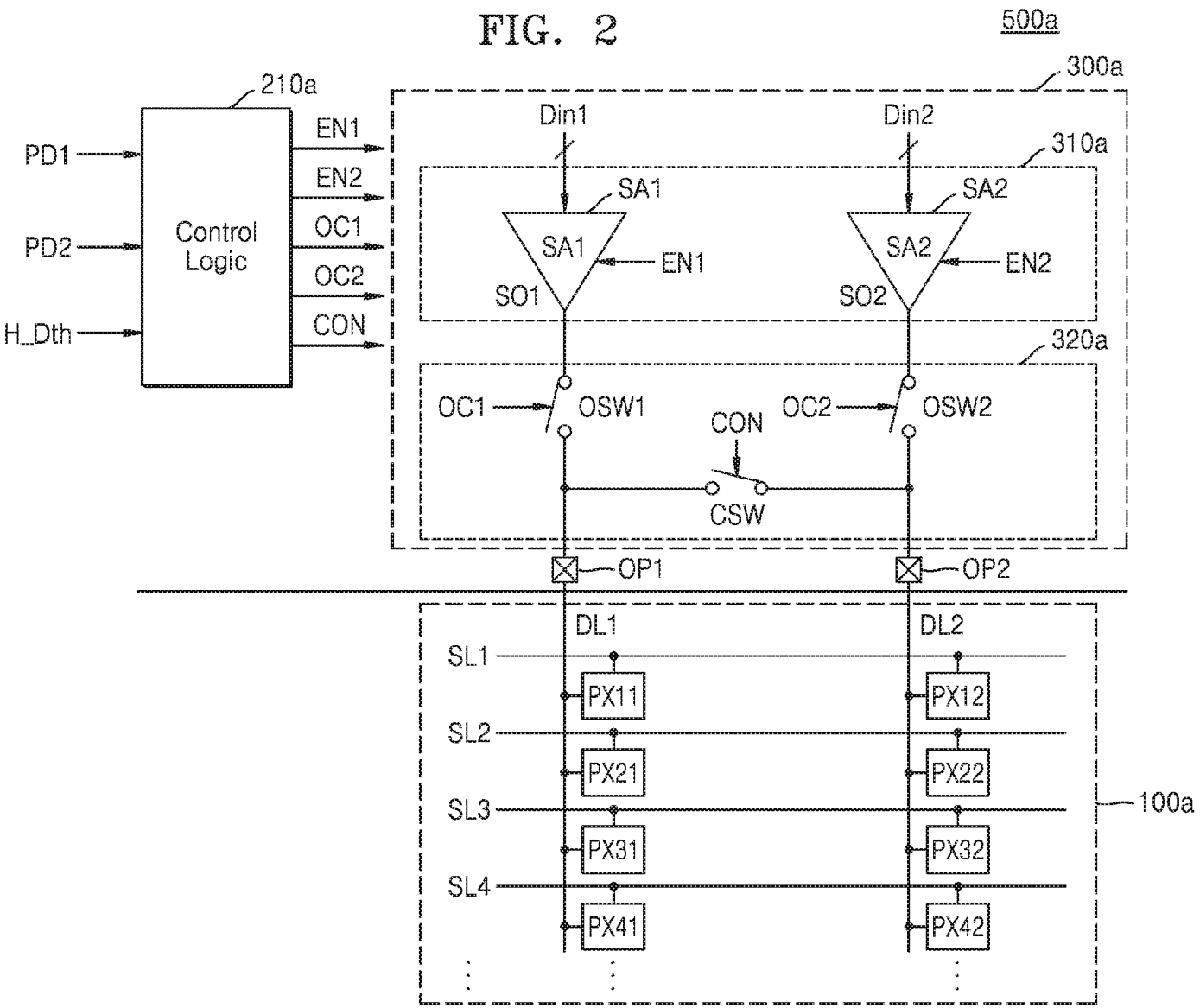
FIG. 2 is a circuit diagram schematically illustrating a display driving circuit according to an example embodiment.
Figure 3:
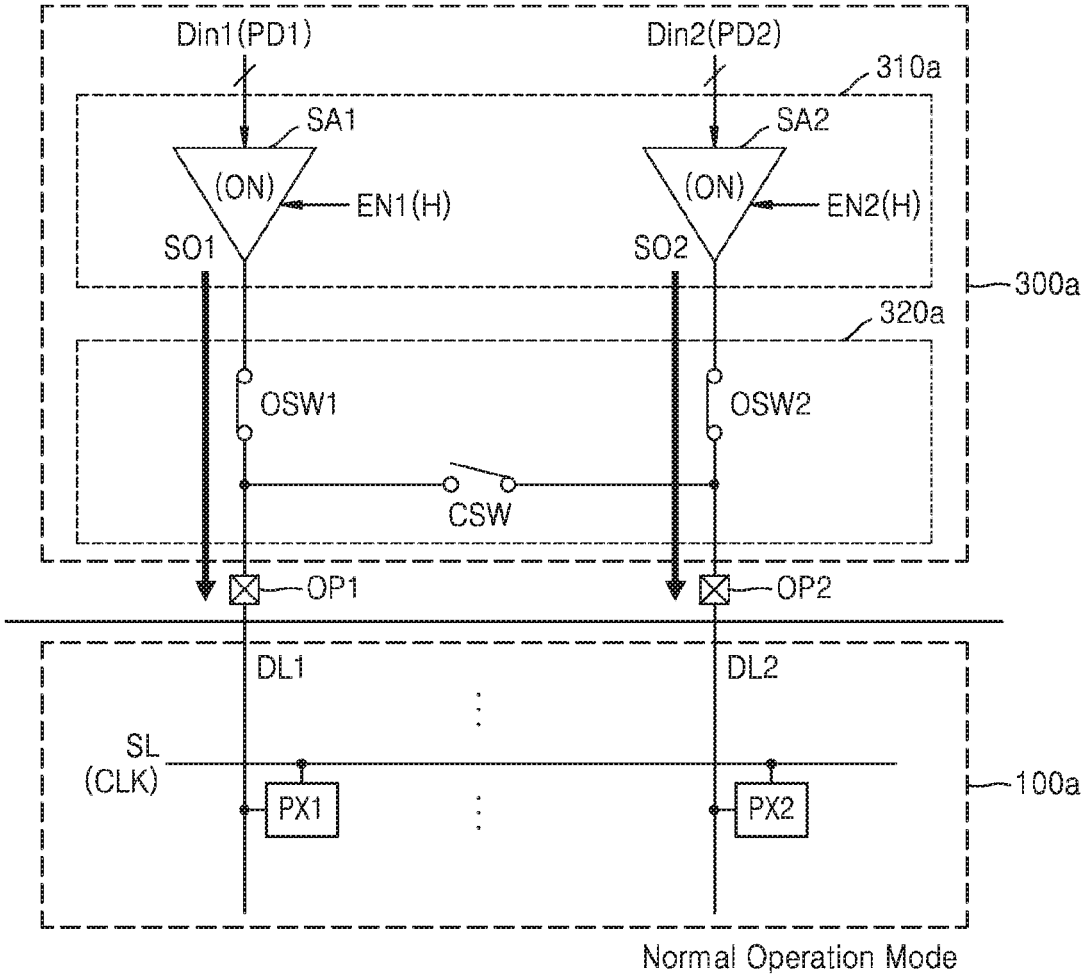
FIG. 3 is a circuit diagram illustrating an operation of a display driver when the display driving circuit of FIG. 2 is driven in a normal operation mode.

FIG. 2 is a circuit diagram schematically illustrating a display driving circuit 500*a* according to an example embodiment. FIG. 3 is a circuit diagram illustrating an operation of a data driver 300*a* when the display driving circuit 500*a* of FIG. 2 is driven in a normal operation mode. FIG. 2 is a circuit diagram for explaining the data driver 300 and the control logic 210 of the display apparatus 1000 of FIG. 1 in detail. The descriptions provided with reference to FIG. 1 may be applied to the present embodiment.

Referring to FIG. 2, the display driving circuit 500*a* may include a control logic 210*a*, the data driver 300*a*, a first output pad OP1, and a second output pad OP2. The display driving circuit 500*a* may further include the components illustrated in FIG. 1.

The data driver 300*a* may include an amplifying circuit 310*a* and an output switching circuit 320*a*. The amplifying circuit 310*a* may generate an output signal based on input data. The amplifying circuit 310*a* may include the first amplifier SA1 and the second amplifier SA2.

For convenience of explanation, the amplifying circuit 310*a* includes two amplifiers, that is, the first amplifier SA1 and the second amplifier SA2, and a display panel 100*a* includes two data lines, that is, the first and second data lines DL1 and DL2. However, as illustrated in FIG. 1, the amplifying circuit 310*a* may include a greater number of amplifiers, and the display panel 100*a* may include a greater number of data lines. Also, the first amplifier SA1 and the second amplifier SA2 are illustrated as being adjacent to each other, but one or more amplifiers may be between the first amplifier SA1 and the second amplifier SA2. In this case, pixels of the same row among the pixels PX11 to PX41 of the first column and the pixels PX12 to PX42 of the second column, for example, the pixel PX11 and the pixel PX12, may be pixels emitting light of the same color, and the first amplifier SA1 and the second amplifier SA2 may output signals corresponding to the same color.

The first amplifier SA1 may be turned on in response to the first enable signal EN1 and may generate a first output signal SO1 based on the first input data Din1. The second amplifier SA2 may be turned on in response to the second enable signal EN2 and may generate a second output signal SO2.

Although not illustrated, the data driver 300*a* further includes a first decoder and a second decoder, the first input data Din1 and the second input data Din2 are converted into gray voltages by the first and second decoders, and pixel signals corresponding to the first input data Din1 and the second input data Din2 may be provided to the first amplifier SA1 and the second amplifier SA2. That is, the first amplifier SA1 and the second amplifier SA2 may respectively output the pixel signals corresponding to the first input data Din1 and the second input data Din2 as the first output signal SO1 and the second output signal SO2. Operations of a data driver will be described below with reference to FIGS. 7A to 8C.

When the display driving circuit 500*a* is driven in a normal operation mode, the first pixel data PD1 may be provided as the first input data Din1, and the second pixel data PD2 may be provided as the second input data Din2. The first pixel data PD1 may correspond to the pixels PX11 to PX41 of the first column connected to the first data line DL1, and the second pixel data PD2 may correspond to the pixels PX12 to PX42 of the second column connected to the second data line DL2. In other words, data values sequentially provided as the first pixel data PD1 respectively correspond to the pixels PX11 to PX41 of the first column, and data values sequentially provided as the second pixel data PD2 respectively correspond to the pixels PX12 to PX42 of the second column.

The output switching circuit 320*a* controls an output path of the output signals from the amplifying circuit 310*a*. The output switching circuit 320*a* may include a first output switch OSW1, a second output switch OSW2, and a connection switch CSW.

The first output switch OSW1 may be connected between an output node the first amplifier SA1 and the first output pad OP1 and may be turned on in response to a first output control signal OC1, thereby providing an output from the first amplifier SA1, e.g., the first output signal SO1, to the first output pad OP1. The second output switch OSW2 may be connected between an output node of the second amplifier SA2 and the second output pad OP2 and may be turned on in response to a second output control signal OC2, thereby providing an output from the second amplifier SA2, e.g., the second output signal SO2, to the second output pad OP2. The connection switch CSW may be connected between the first output pad OP1 and the second output pad OP2 and may be turned on in response to the connection control signal CON, thereby providing the output from the first amplifier SA1 to the second output pad OP2 or the output from the second amplifier SA2 to the first output pad OP1.

The control logic 210*a* may control the operation of the data driver 300*a* and may generate data driver control signals (hereinafter, referred to as control signals) for controlling the data driver 300*a*. For example, the control signals may include the first enable signal EN1, the second enable signal EN2, the first output control signal OC1, the second output control signal OC2, and the connection control signal CON. The control signals may further include other signals.

The control logic 210*a* may control turning on or off of the first amplifier SA1 and the second amplifier SA2, i.e., the operations of the first amplifier SA1 and the second amplifier SA2, and may control output paths of the outputs from the first amplifier SA1 and the second amplifier SA2, based on the first enable signal EN1, the second enable signal EN2, the first output control signal OC1, the second output control signal OC2, and the connection control signal CON.

According to an example embodiment, before the data driver 300*a* drives the first data line DL1 and the second data line DL2 in the display panel 100*a* based on the first pixel data PD1 and the second pixel data PD2, the control logic 210*a* may receive and analyze the first pixel data PD1 and the second pixel data PD2 and may generate the control signals based on an analysis result. For example, when the received first pixel data PD1 and second pixel data PD2 respectively correspond to pixels PX31 and PX32 of a third horizontal line, the control logic 210*a* may analyze the first pixel data PD1 and the second pixel data PD2 before a third horizontal driving period, e.g., during the second horizontal driving period, and may generate the control signals based on an analysis result. The data driver 300*a* may be driven during the third horizontal driving period, in response to the control signals.

When the display driving circuit 500*a* is driven in a normal operation mode, the control logic 210*a* may generate the control signals regardless of the first pixel data PD1 and the second pixel data PD2. For example, the control logic 210*a* may generate the first enable signal EN1, the second enable signal EN2, the first output control signal OC1, and the second output control signal OC2 which are logic high, and may generate the connection control signal CON that is logic low.

Referring to FIG. 3, in the normal operation mode, the first amplifier SA1, the second amplifier SA2, the first output switch OSW1, and the second output switch OSW2 are turned on respectively in response to the first enable signal EN1, the second enable signal EN2, the first output control signal OC1, and the second output control signal OC2 which are logic high, and the connection switch CSW may be turned off in response to the connection control signal CON that is logic low.

The first pixel data PD1 corresponding to the first pixel PX1 may be provided to the first amplifier SA1 as the first input data Dint, and the second pixel data PD2 corresponding to the second pixel PX2 may be provided to the second amplifier SA2 as the second input data Din2. Therefore, the first amplifier SA1 may drive the first data line DL1 based on the first pixel data PD1, and the second amplifier SA2 may drive the second data line DL2 based on the second pixel data PD2.

A first pixel signal (or an image signal) corresponding to the first pixel data PD1 may be output as the output from the first amplifier SA1, that is, the first output signal SO1, and a second pixel signal corresponding to the second pixel data PD2 may be output as the output from the second amplifier SA2, that is, the second output signal SO2. The first amplifier SA1 may charge the first data line DL1 in response to the first pixel signal corresponding to the first pixel data PD1, and the second amplifier SA2 may charge the second data line DL2 in response to the second pixel signal corresponding to the second pixel data PD2. When the scan clock signal CLK is applied to the scan line SL, the first pixel signal used to charge the first data line DL1 may be provided to the first pixel PX1, and the second pixel signal used to charge the second data line DL2 may be provided to the second pixel PX2.

Referring back to FIG. 2, when the display driving circuit 500*a* is driven in a low-power operation mode, the control logic 210*a* may analyze an image pattern, for example, the first pixel data PD1 and the second pixel data PD2, and may generate the control signals based on an analysis result.

The control logic 210*a* may generate the control signals based on the first pixel data PD1, the second pixel data PD2, and the horizontal threshold value H_Dth. The control logic 210*a* may calculate a data difference between the first pixel data PD1 and the second pixel data PD2 and may compare the calculated data difference with the horizontal threshold value H_Dth.

When the data difference is less than or equal to the horizontal threshold value H_Dth, the control logic 210*a* may turn off one of the first amplifier SA1 and the second amplifier SA2 and may generate the control signals for controlling the other one of the first amplifier SA1 and the second amplifier SA2 in such a manner that the other amplifier drives the first data line DL1 and the second data line DL2 based on the first pixel data PD1 and the second pixel data PD2. According to an example embodiment, the second amplifier SA2 may be turned off, and the first amplifier SA1 may drive the first data line DL1 and the second data line DL2 based on the first pixel data PD1 and the second pixel data PD2.

When the data difference is greater than the horizontal threshold value H_Dth, the control logic 210*a* may control the first amplifier SA1 and the second amplifier SA2 in such a manner that the first amplifier SA1 drives the first data line DL1 based on the first pixel data PD1 and the second amplifier SA2 drives the second data line DL2 based on the second pixel data PD2. The operation of the data driver 300*a* in the low-power operation mode is the same as that of the data driver 300*a* in the normal operation mode, and thus, the detailed descriptions thereof will be omitted herein.

Hereinafter, referring to FIGS. 4A to 5, the operation of the data driver 300*a* when the data difference between the first pixel data PD1 and the second pixel data PD2 is less than or equal to the horizontal threshold value H_Dth will be described.

Figure 4A:
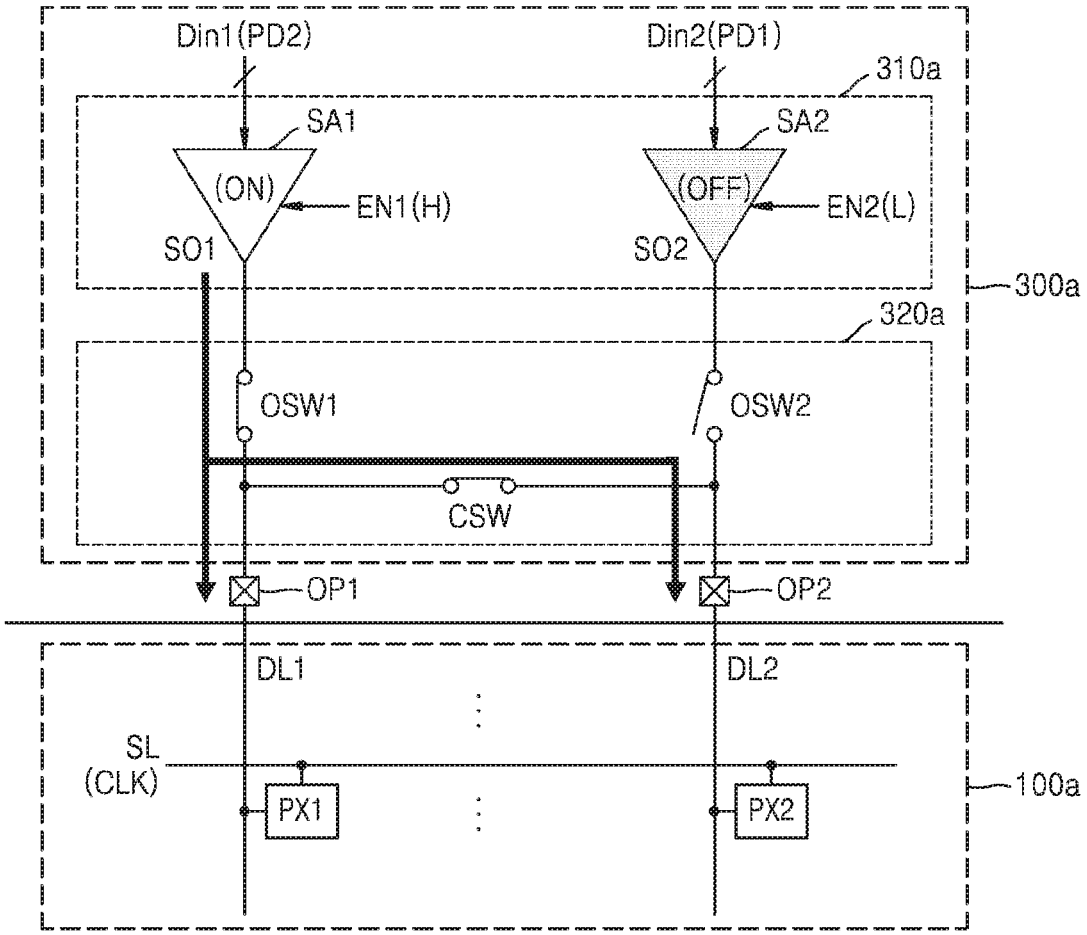
FIGS. 4A and 4B are circuit diagrams respectively illustrating coarse driving and fine driving of a data driver when the display driving circuit of FIG. 2 is driven in a low-power operation mode.
Figure 4B:
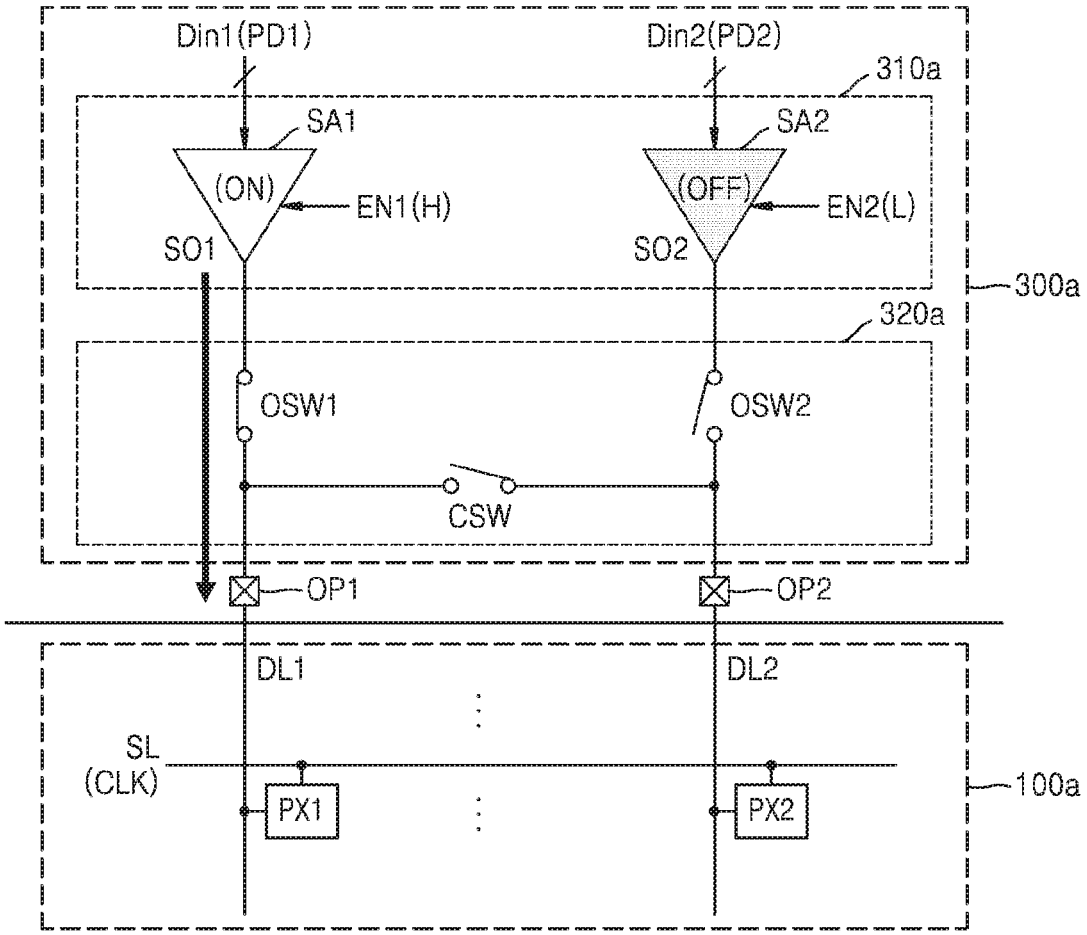

FIGS. 4A and 4B are circuit diagrams respectively illustrating coarse driving and fine driving of the data driver 300*a* when the display driving circuit 500*a* of FIG. 2 is driven in a low-power operation mode. FIG. 5 is a timing diagram illustrating operations of the data driver 300*a* of FIGS. 4A and 4B.

Figure 5:
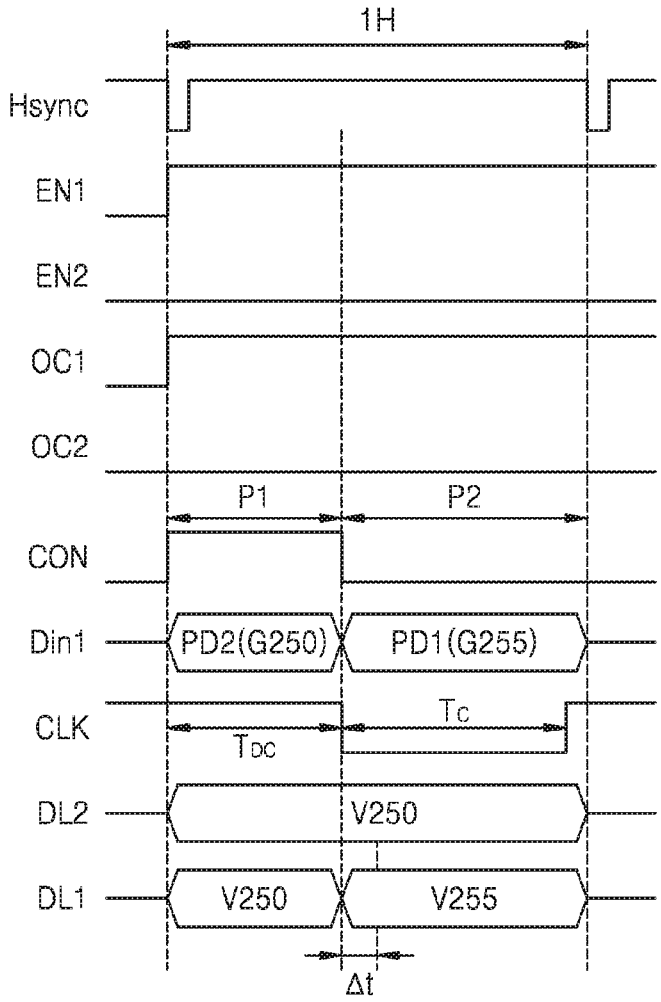
FIG. 5 is a timing diagram illustrating operations of the data driver of FIGS. 4A and 4B.

Referring to FIGS. 4A to 5, the first amplifier SA1 may coarse-drive the first data line DL1 and the second data line DL2 during a first period P1 of one horizontal driving period 1H and may fine-drive the second data line DL2 during a second period P2 of the horizontal driving period 1H.

When the data difference between the first pixel data PD1 and the second pixel data PD2 is less than or equal to the horizontal threshold value H_Dth, the first enable signal EN1 may be logic high, and the second enable signal EN2 may be logic low. Also, the first output control signal OC1 is logic high, and the second output control signal OC2 is logic low. Therefore, the output from the first amplifier SA1 may be provided to the first data line DL1.

Referring to FIGS. 4A and 5, the second pixel data PD2 may be provided to the first amplifier SA1 as the first input data Din1 during the first period P1 of the horizontal driving period 1H, and the connection control signal CON may be logic high. Thus, the first amplifier SA1 may drive the first data line DL1 and the second data line DL2 based on the second pixel data PD2. For example, when the second pixel data PD2 has a grayscale of 250, the first amplifier SA1 transmits a second pixel signal corresponding to the grayscale of 250, for example, a 250 gray voltage V250, to the first data line DL1 and the second data line DL2 during the first period P1, and the first data line DL1 and the second data line DL2 may be charged to a level of the 250 gray voltage V250.

Referring to FIGS. 4B and 5, the first pixel data PD1 may be provided to the first amplifier SA1 as the first input data Din1 during the second period P2 of the horizontal driving period 1H, and the connection control signal CON may be logic low. Thus, the first amplifier SA1 may drive the first data line DL1 based on the first pixel data PD1. For example, when the first pixel data PD1 has a grayscale of 255, the first amplifier SA1 may transmit a first pixel signal corresponding to the grayscale of 255, for example, a 255 gray voltage V255, to the first data line DL1 during the second period P2. Therefore, a voltage level of the first data line DL1 may increase from the level of the 250 gray voltage V250 to a level of the 255 gray voltage V255.

The first amplifier SA1 may coarse-drive the first data line DL1 and the second data line DL2 based on the second pixel data PD2 corresponding to the second pixel PX2 connected to the second data line DL2 during the first period P1 and then may fine-drive the first data line DL1 based on the first pixel data PD1 corresponding to the first pixel PX1 connected to the first data line DL1 during the second period P2. Accordingly, the second pixel signal corresponding to the second pixel data PD2, for example, the 250 gray voltage V250, may be transmitted to the second data line DL2, and the second pixel signal corresponding to the first pixel data PD1, for example, the 255 gray voltage V255, may be transmitted to the first data line DL1.

The horizontal driving period 1H may include a data charging time TDC and a threshold voltage compensation time Tc. The scan clock signal CLK that is logic high may be provided to the scan line SL during the data charging time TDC, and the first data line DL1 and the second data line DL2 may be charged at this time. During the threshold voltage compensation time Tc, the first pixel PX1 may store the first pixel signal provided through the first data line DL1 in response to the scan clock signal CLK that is logic low, and the second pixel PX2 may store the second pixel signal provided through the second data line DL2. The data charging time TDC may be set based on a full-range transition of pixel data. For example, when a minimum value of the pixel data is a grayscale of 0 and a maximum value thereof is a grayscale of 255, the data charging time TDC may be set based on a time required to charge the first data line DL1 and the second data line DL2 from a 0 gray voltage V0 to the 255 grayscale voltage V255. The data charging time TDC and the threshold voltage compensation time Tc will be described with reference to FIG. 6.

Figure 6:
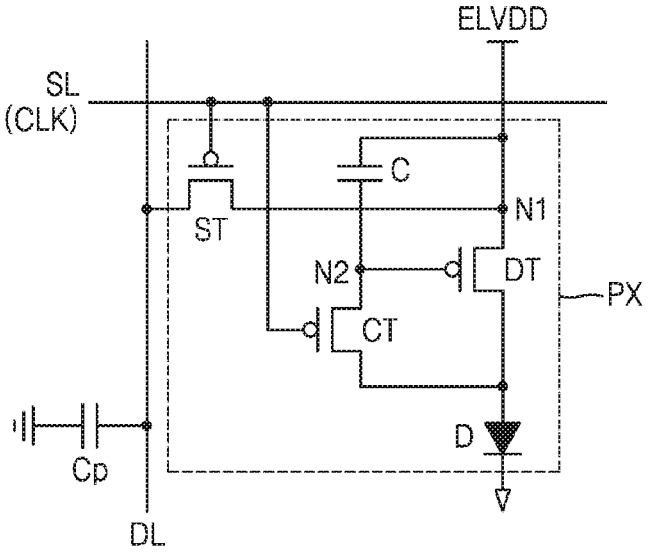
FIG. 6 is a circuit diagram illustrating an example of a pixel included in a display panel.

FIG. 6 is a circuit diagram illustrating an example of a pixel PX included in a display panel. Referring to FIG. 6, the pixel PX may include a switching transistor ST, a driving transistor DT, a compensation transistor CT, a capacitor C, and an organic light-emitting diode D. FIG. 6 illustrates that the switching transistor ST, the driving transistor DT, and the compensation transistor CT are P-channel metal oxide semiconductor (PMOS) transistors, but one or more example embodiments are not limited thereto. The switching transistor ST, the driving transistor DT, and the compensation transistor CT may be implemented as N-channel MOS (NMOS) transistors. During the data charging time TDC, the scan clock signal CLK may be logic high. When the scan clock signal CLK is logic high, the switching transistor ST is turned off, and when a driving signal such as a gray voltage is transmitted to the data line DL, the data line DL may be charged to a level of the driving signal. The data line DL is connected to the pixels PX, and thus a parasitic capacitor Cp may be formed. Therefore, a considerable amount of time may be taken to charge the data line DL to the level of the driving signal.

Then, the scan clock signal CLK may be logic low during the threshold voltage compensation time Tc. When the scan clock signal CLK transitions from logic high to logic low, the switching transistor ST and the compensation transistor CT may be turned on, and a pixel signal, that is, a gray voltage, may be provided to a first node N1. As the compensation transistor CT is turned on, the driving transistor DT operates as a diode, and a potential of the second node N2 is increased to a voltage level that is obtained by subtracting a threshold voltage Vth (hereinafter, referred to as a threshold voltage) of the driving transistor DT from a data voltage Vdata, that is, a voltage of the pixel signal. That is, a voltage, at which the threshold voltage Vth is compensated for the data voltage Vdata, is stored in the capacitor C. A current corresponding to a difference between gate and source voltages of the driving transistor T (e.g., ELVDD-(Vdata-Vth)) flows in the organic light-emitting diode D, the organic light-emitting diode D emits light. In this case, although the threshold voltages Vth of the driving transistors DT are different between pixels, a current supplied to the organic light-emitting diode D through the driving transistor DT is uniform, light emitted from the pixels has the same brightness.

Referring back to FIG. 5, the first period P1 may overlap the data charging time TDC, and the second period P2 may overlap the threshold voltage compensation time Tc. That is, the first amplifier SA1 may coarse-drive the first data line DL1 and the second data line DL2 based on the second pixel data PD2 during the data charging time TDC and may fine-drive the first data line DL1 based on the first pixel data PD1 during the threshold voltage compensation time Tc. The data difference between the second pixel data PD2 and the first pixel data PD1 is less than or equal to the horizontal threshold value, a time, during which a voltage level of the first data line DL1 is increased or decreased from a gray voltage level corresponding to the second pixel data PD2 to a gray voltage level corresponding to the first pixel data PD1, that is, an actual fine driving time Δt, may be remarkably short. Therefore, although the fine driving time Δt overlaps the threshold voltage compensation time Tc, the fine driving time Δt may not greatly affect compensation for a threshold voltage of the first pixel PX1.

FIG. 5 illustrates that a point in time when the scan clock CLK becomes logic low is the same as a point in time when the connection control signal CON becomes logic low, in other words, a start point of the second period P2. However, one or more example embodiments are not limited thereto. The start point of the second period P2 may be faster than the point in time when the scan clock CLK becomes logic low. Accordingly, the fine driving time Δt of the first data line DL1 may partially overlap a data charging time TDC. According to an example embodiment, the first period P1 and the second period P2 may be included within the data charging time TDC.

As described above, one amplifier included in the display driving circuit **500*a* according to an example embodiment may drive two pixels when two pixel data are the same or the data difference between the pieces of the pixel data is less than or equal to the horizontal threshold value. Also, the display driving circuit 500*a* may drive two pixels through coarse driving and fine driving without increasing the horizontal driving period 1H. Accordingly, the display driving circuit 500*a*** may decrease static current consumption without deterioration in image display quality.

Figure 7A:
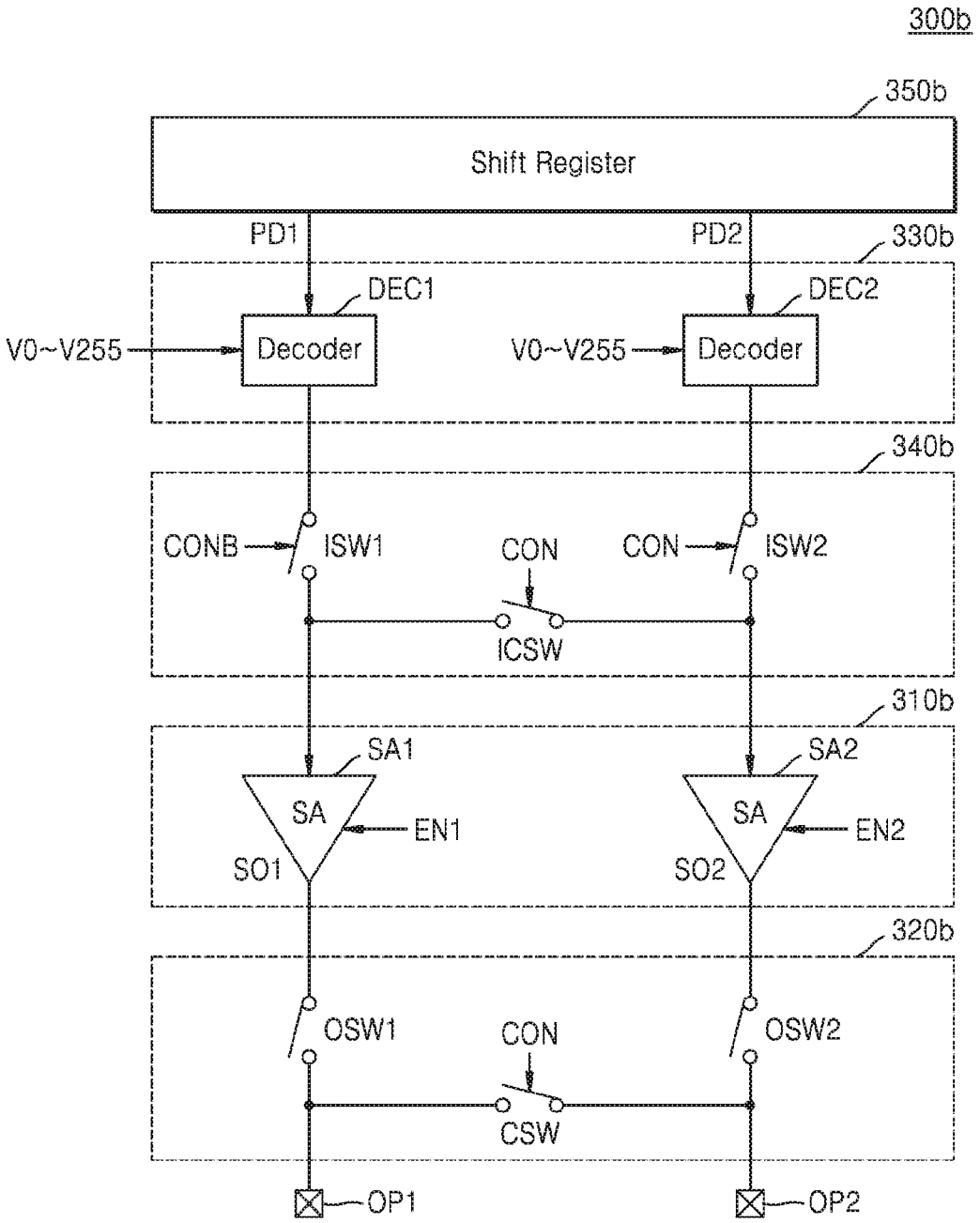
FIG. 7A is a circuit diagram illustrating an example of a data driver according to an example embodiment.
Figure 7B:
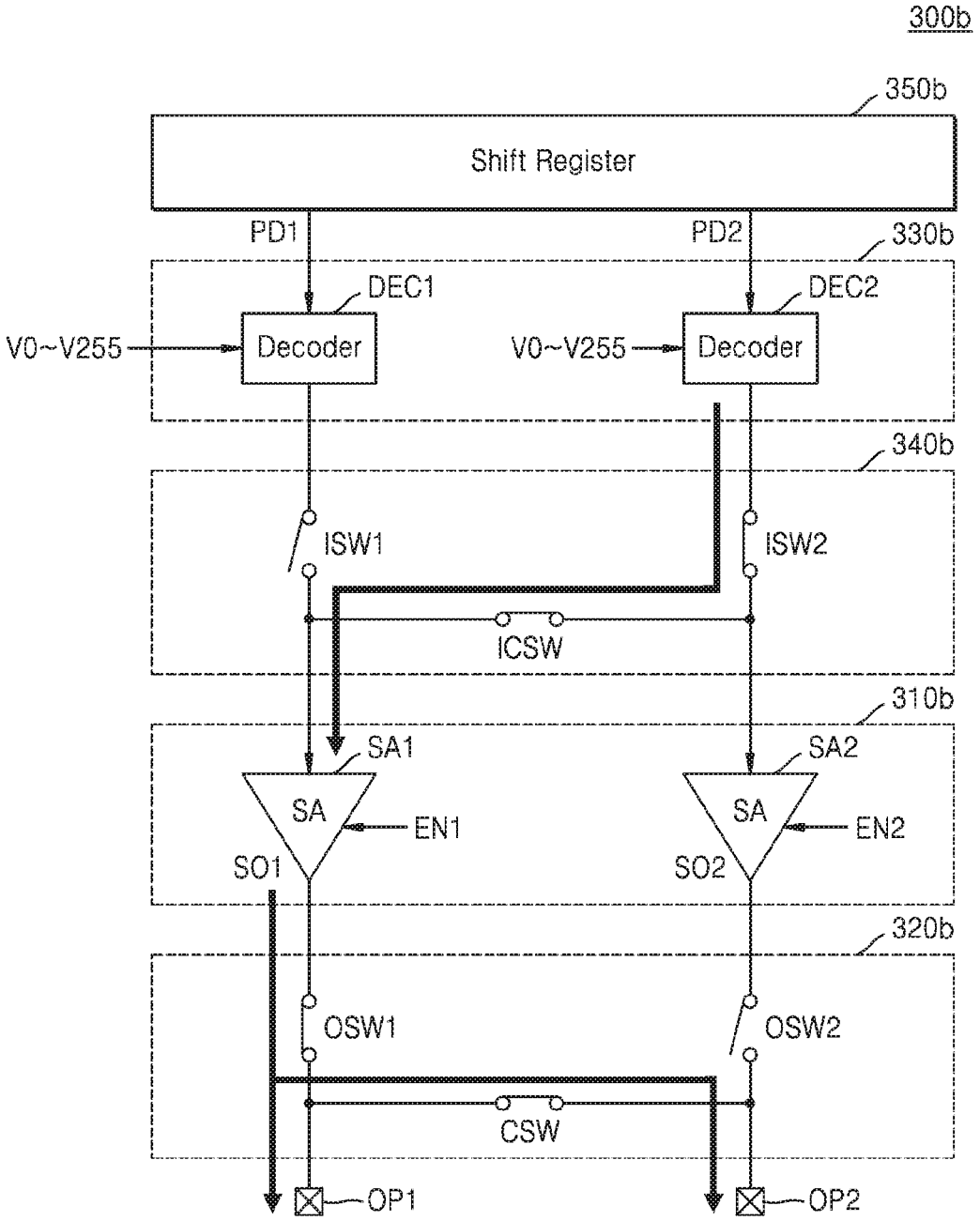
FIGS. 7B and 7C are circuit diagrams illustrating operations of the data driver of FIG. 7A.
Figure 7C:
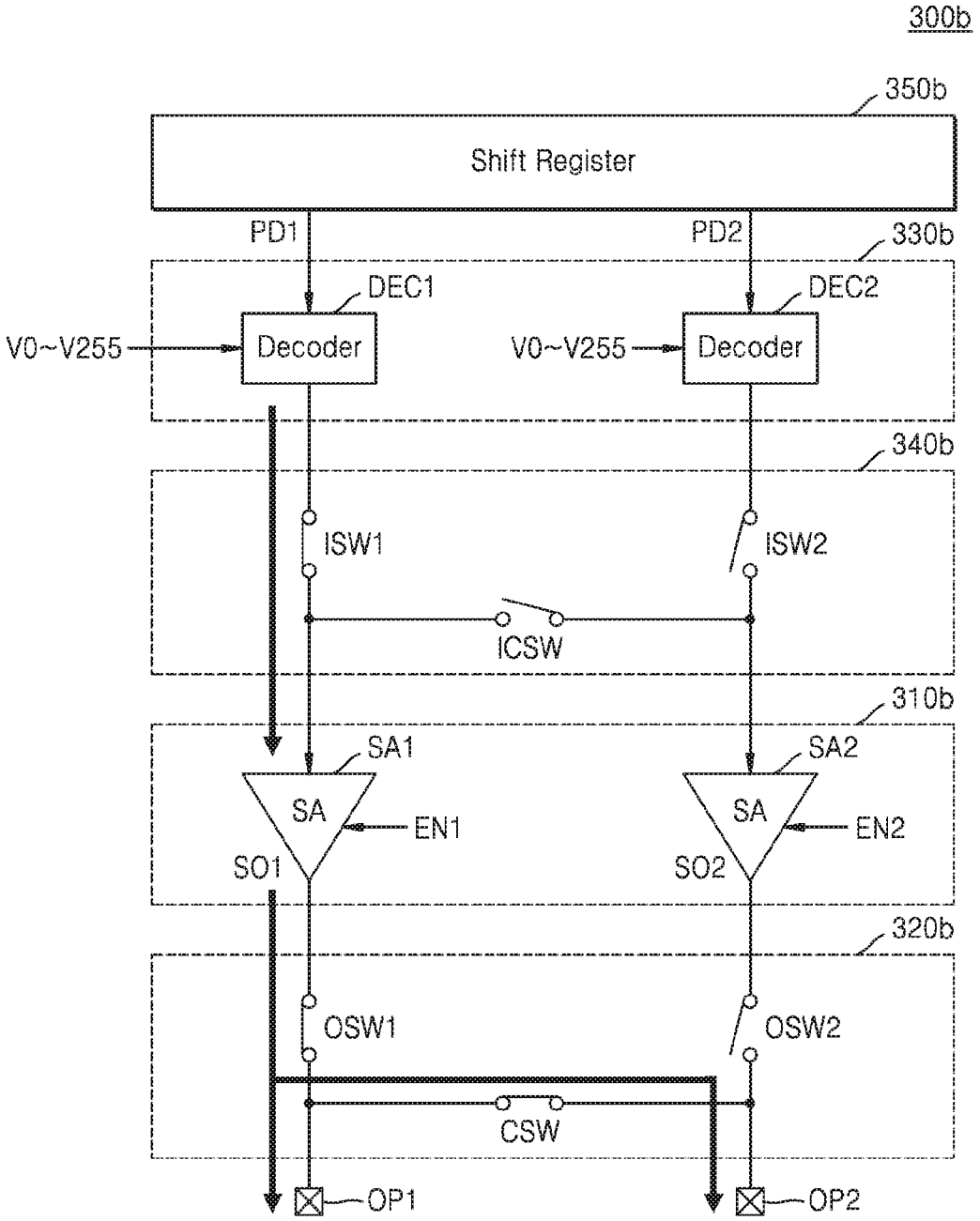

FIG. 7A is a circuit diagram illustrating an example of a data driver **300*b* according to an example embodiment. FIGS. 7B and 7C are circuit diagrams illustrating operations of the data driver 300*b*** of FIG. 7A.

Referring to FIG. 7A, the data driver 300*b* may include an amplifying circuit 310*b*, an output switching circuit 320*b*, a decoder 330*b*, an input switching circuit 340*b*, and a shift register 350*b*.

The shift register 350*b* may store the image data DATA, for example, pixel data of one line, which is provided by the timing controller 300 (of FIG. 1) and may output the pixel data of one line in synchronization with the synchronization signal Hsync (of FIG. 5) or a timing signal generated based on the horizontal synchronization signal Hsync. For example, the shift register 350*b* may output the first pixel data PD1 and the second pixel data PD2.

The decoder 330*b* may include a first decoder DEC1 and a second decoder DEC2. The first decoder DEC1 may select a gray voltage corresponding to the first pixel data PD1 from among gray voltages V0 to V255 and may output the selected gray voltage as a first pixel signal. The second decoder DEC2 may select a gray voltage corresponding to the second pixel data PD2 from among the gray voltages V0 to V255 and may output the selected gray voltage as a second pixel signal.

The input switching circuit 340*b* may include a first input switch ISW1, a second input switch ISW2, and an input connection switch ICSW. The first input switch ISW1 may be turned on or off in response to a first input control signal ICON1, and the second input switch ISW2 and the input connection switch ICSW may be turned on or off in response to a second input control signal ICON2. The first input control signal ICON1 and the second input control signal ICON2 may be provided by the control logic 210*a* (of FIG. 2), or the first enable signal EN1, the second enable signal EN2, and the connection control signal CON may be logically obtained and generated. For example, the first input control signal ICON1 may be a signal generated through an exclusive OR operation of the first enable signal EN1 and the connection control signal CON, and the second input control signal ICON2 may be a signal generated through an exclusive OR operation of the second enable signal EN2 and the connection control signal CON.

When the display driving circuit 500*a* (of FIG. 2) is driven in a normal operation mode, the first input switch ISW1 and the second input switch ISW2 may be turned on, and the input connection switch ICSW may be turned off. Accordingly, the first decoder DEC1 may provide the first pixel signal to the first amplifier SA1, and the second decoder DEC2 may provide the second pixel signal to the second amplifier SA2.

When the display driving circuit 500*a* is driven in a low-power operation mode, as illustrated in FIG. 7B, the first input switch ISW1 may be turned off, the second input switch ISW2 and the input connection switch ICSW may be turned on during the first period of the horizontal driving period, and thus the second decoder DEC2 provides the second pixel signal to the first amplifier SA1. As illustrated in FIG. 7C, the first input switch ISW1 is turned on, the second input switch ISW2 and the input connection switch ICSW are turned off during the second period of the horizontal driving period, and thus, the first decoder DEC1 may provide the first pixel signal to the first amplifier SA1. Accordingly, the first amplifier SA1 may output the second pixel signal by using the first output pad OP1 and the second output pad OP2 during the first period and may output the first pixel signal by using the first output pad OP1 during the second period. The operations of the amplifying circuit 310*b* and the output switching circuit 320*b* are the same as the operations of the amplifying circuit 310*a* and the output switching circuit 320*a* which are described with reference to FIG. 2, and thus, detailed descriptions thereof will be omitted herein.

Figure 8A:
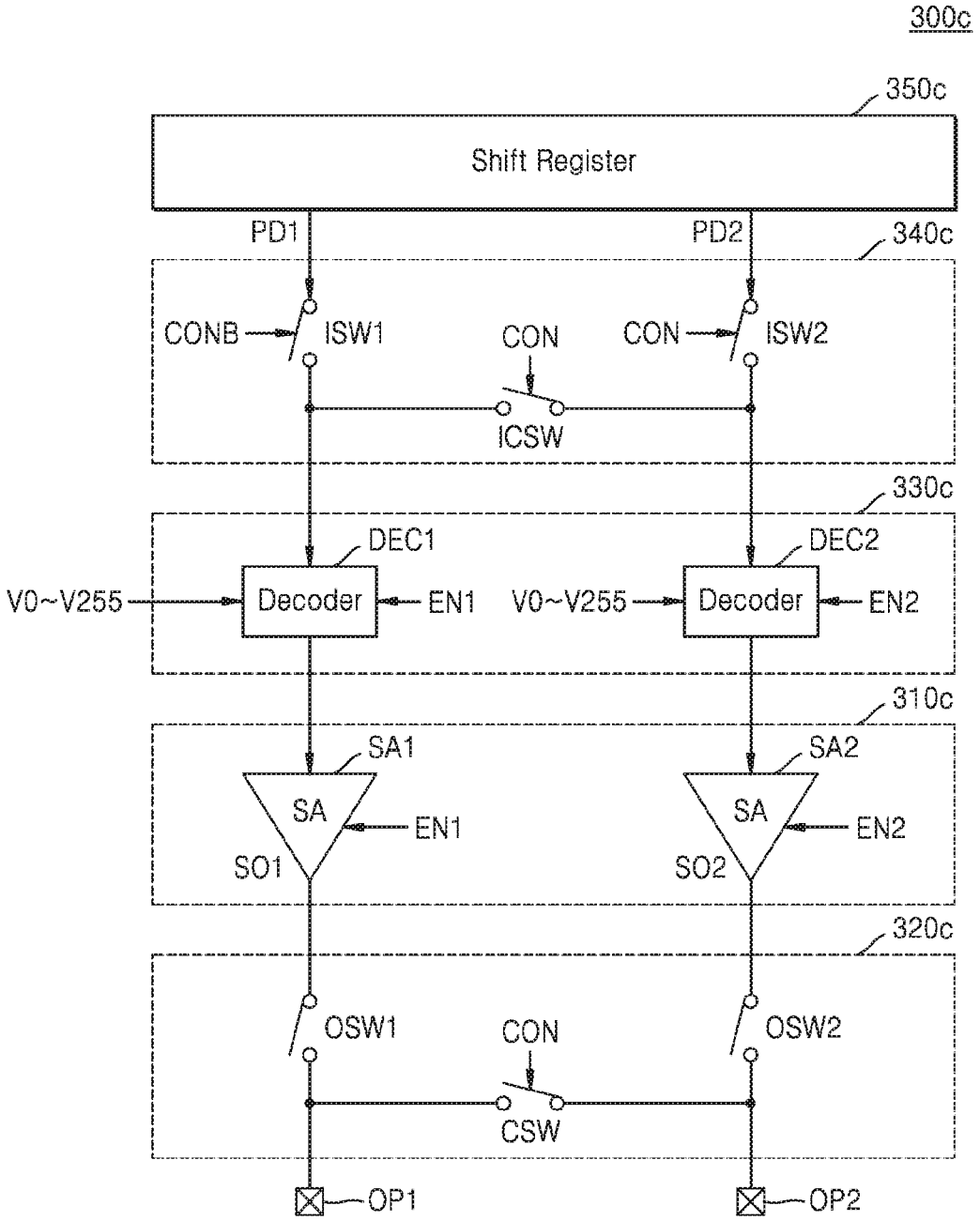
FIG. 8A is a circuit diagram illustrating an example of a data driver according to an example embodiment.
Figure 8B:
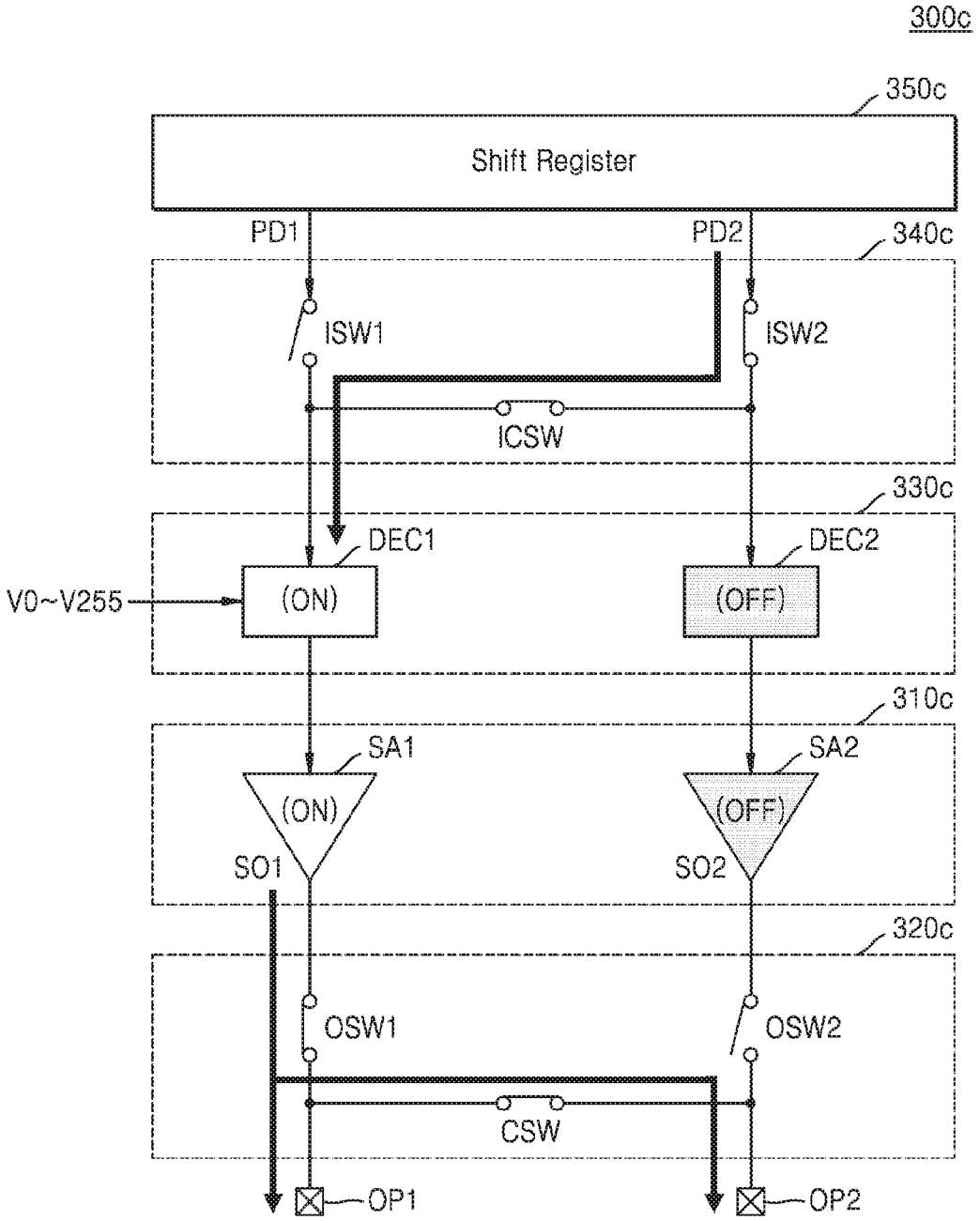
FIGS. 8B and 8C are circuit diagrams illustrating operations of the data driver of FIG. 8A.
Figure 8C:
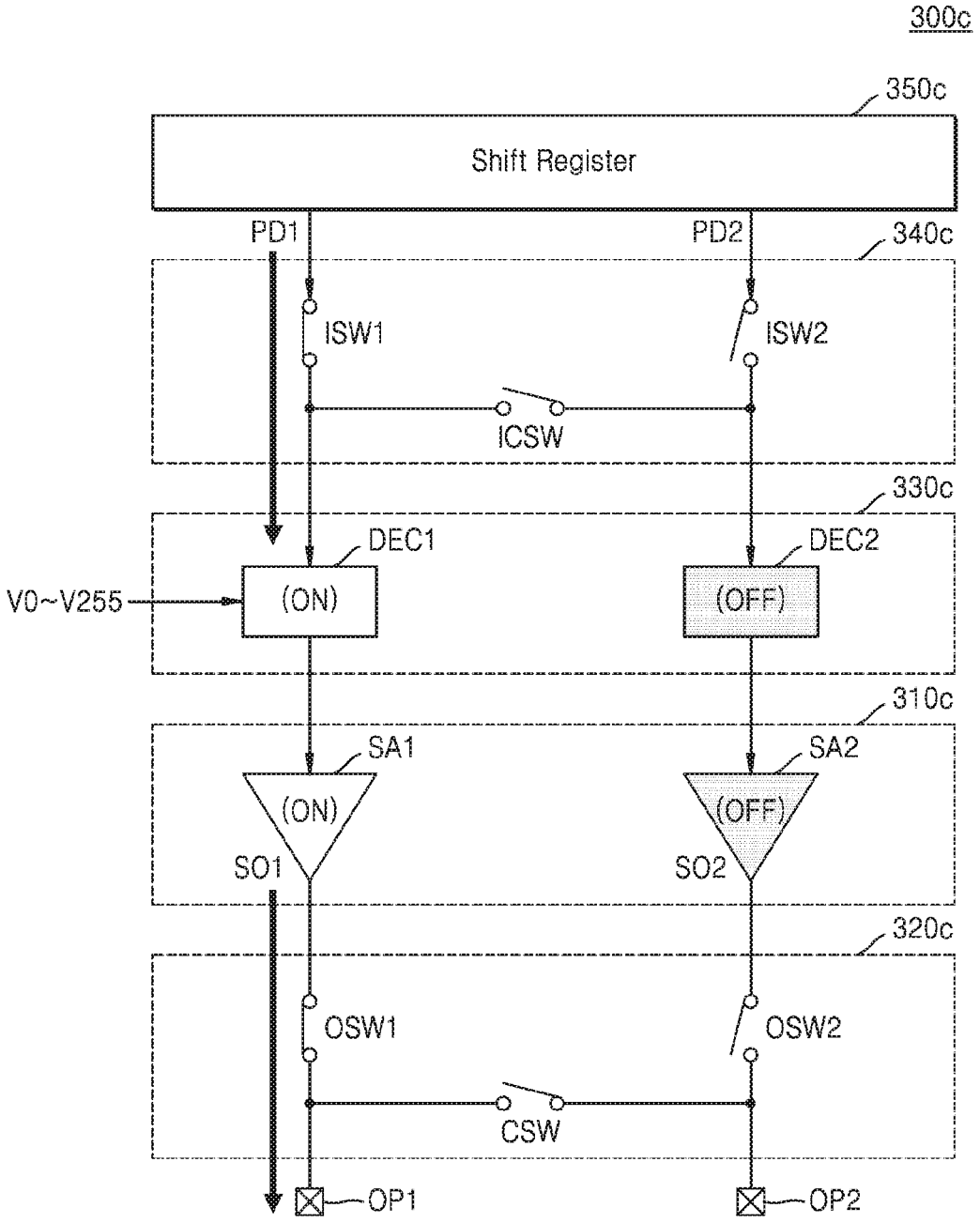

FIG. 8A is a circuit diagram illustrating an example of a data driver 300*c* according to an example embodiment. FIGS. 8B and 8C are circuit diagrams illustrating operations of the data driver 300*c* of FIG. 8A.

Referring to FIG. 8A, the data driver 300*c* may include an amplifying circuit 310*c*, an output switching circuit 320*c*, a decoder 330*c*, an input switching circuit 340*c*, and a shift register 350*c*. Compared to the data driver 300*b* of FIG. 7A, the input switching circuit 340*c* may be connected between the shift register 350*c* and the decoder 330*c*.

When the display driving circuit 500*a* (of FIG. 2) is driven in a normal operation mode, the first input switch ISW1 and the second input switch ISW2 may be turned on, and the input connection switch ICSW may be turned off. Accordingly, the first decoder DEC1 may provide the first pixel signal to the first amplifier SA1, and the second decoder DEC2 may provide the second pixel signal to the second amplifier SA2.

When the display driving circuit 500*a* is driven in a low-power operation mode, the second decoder DEC2 may not be driven. As illustrated in FIG. 8B, the first input switch ISW1 is turned off, the second input switch ISW2 and the input connection switch ICSW are turned on during the first period of the horizontal driving period. Thus, the second pixel data PD2 may be input to the first decoder DEC1, and the first decoder DEC1 may provide the second pixel signal to the first amplifier SA1. Also, as illustrated in FIG. 8C, the first input switch ISW1 is turned on, and the second input switch ISW2 and the input connection switch ICSW are turned off during the second period of the horizontal driving period. Thus, the first pixel data PD1 may be input to the first decoder DEC1, and the first decoder DEC1 may provide the first pixel signal to the first amplifier SA1.

Figure 9:
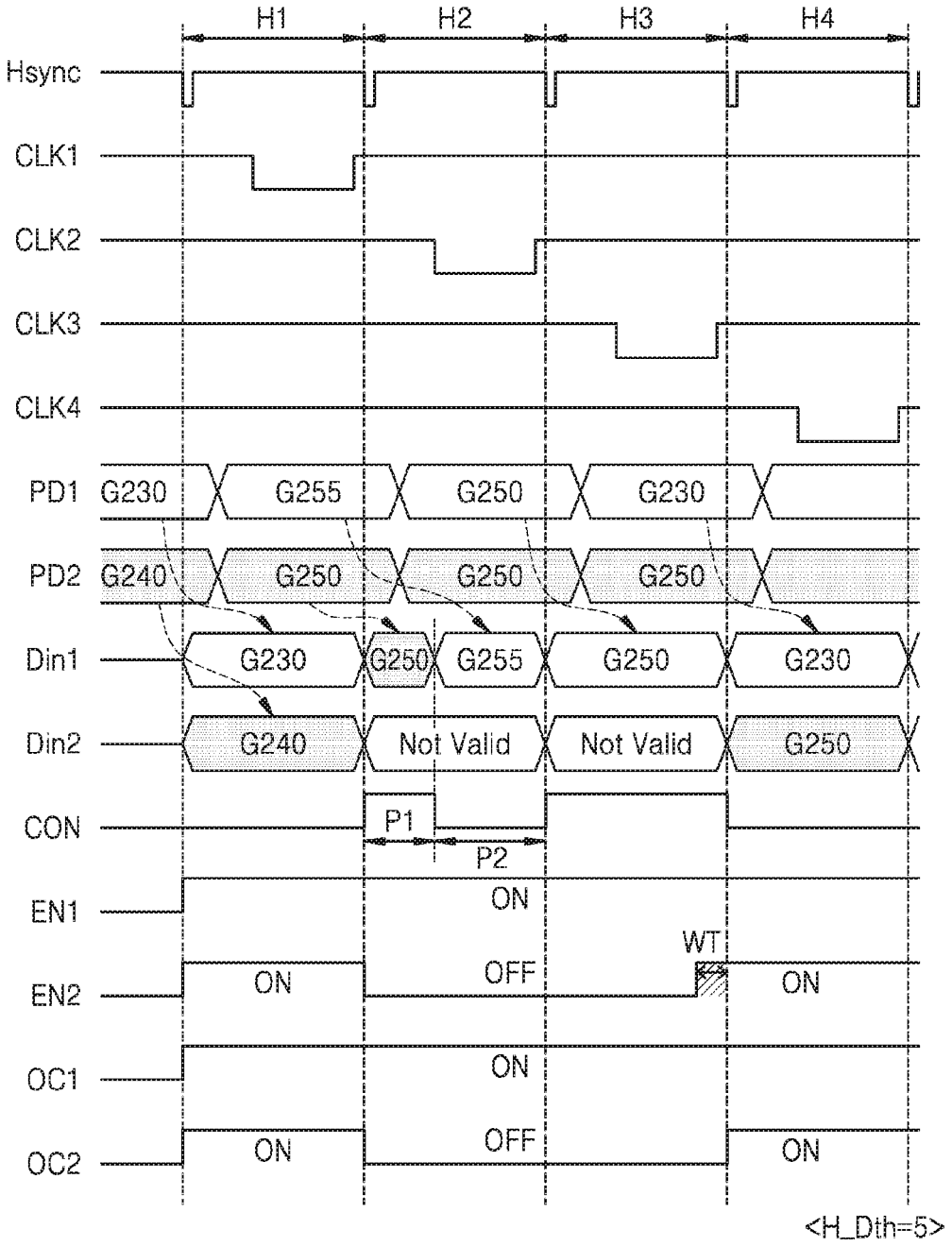
FIG. 9 is a timing diagram illustrating an example of the display driving circuit of FIG. 2.

FIG. 9 is a timing diagram illustrating an example of the display driving circuit 500*a* of FIG. 2.

Referring to FIG. 9, the horizontal threshold value H_Dth is 5, and as illustrated, it is assumed that the control logic 210*a* (of FIG. 2) sequentially receives pieces G230, G255, G250, and G230 of the pixel data, which respectively correspond to the first pixels PX11 to PX41 connected to the first data line DL1, as the first pixel data PD1, and sequentially receives pieces G240, G250, G250, and G250, which respectively correspond to the second pixels PX12 to PX42 connected to the second data line DL2, as the second pixel data PD2.

In response to the horizontal synchronization signal Hsync, the first pixel data PD1 and the second pixel data PD2 may be provided as the first input data Din1 of the first amplifier SA1 and/or the second input data Din2 of the second amplifier SA2. The first pixel data PD1 received by the control logic 210*a* during the first horizontal driving period H1 is G255, and the second pixel data PD2 received by the control logic 210*a* during the first horizontal driving period H1 is G250. The data difference between the first pixel data PD1 and the second pixel data PD2 is 5, which is less than or equal to the horizontal threshold value H_Dth. Therefore, based on the control signals, that is, the first enable signal EN1, the second enable signal EN2, the first output control signal OC1, the second output control signal OC2, and the connection control signal CON, which are output from the control logic 210*a*, the second amplifier SA2 is turned off, and the first amplifier SA1 is turned on during the second horizontal driving period H2 such that the first data line DL1 and the second data line DL2 may be driven during the first period P1 based on the second pixel data PD2 that is G250, and the first data line DL1 may be driven during the second period P2 based on the first pixel data PD1 that is G255.

Both the first pixel data PD1 and the second pixel data PD2, which are received by the control logic 210*a* during the second horizontal driving period H2, are G250. During the third horizontal driving period H3, the second amplifier SA2 may be turned off, and the first amplifier SA1 may drive the first data line DL1 and the second data line DL2 based on the first pixel data PD1.

The first pixel data PD1 received during the third horizontal driving period H3 is G230, while the second pixel data PD2 received during the third horizontal driving period H3 is G250. The data difference between the first pixel data PD1 and the second pixel data PD2 is 20, which is greater than the horizontal threshold value H_Dth. Thus, both the first amplifier SA1 and the second amplifier SA2 may be turned on during a fourth horizontal driving period H4. Since the second amplifier SA2 is turned off during the third horizontal driving period H3, the second enable signal EN2 transitions to logic high in advance before the fourth horizontal driving period H4 by taking into account a time WT taken for the second amplifier SA2 to be turned on and normally operates, and in response to the second enable signal EN2, the second amplifier SA2 may be turned on in advance before the fourth horizontal driving period H4.

Figure 10:
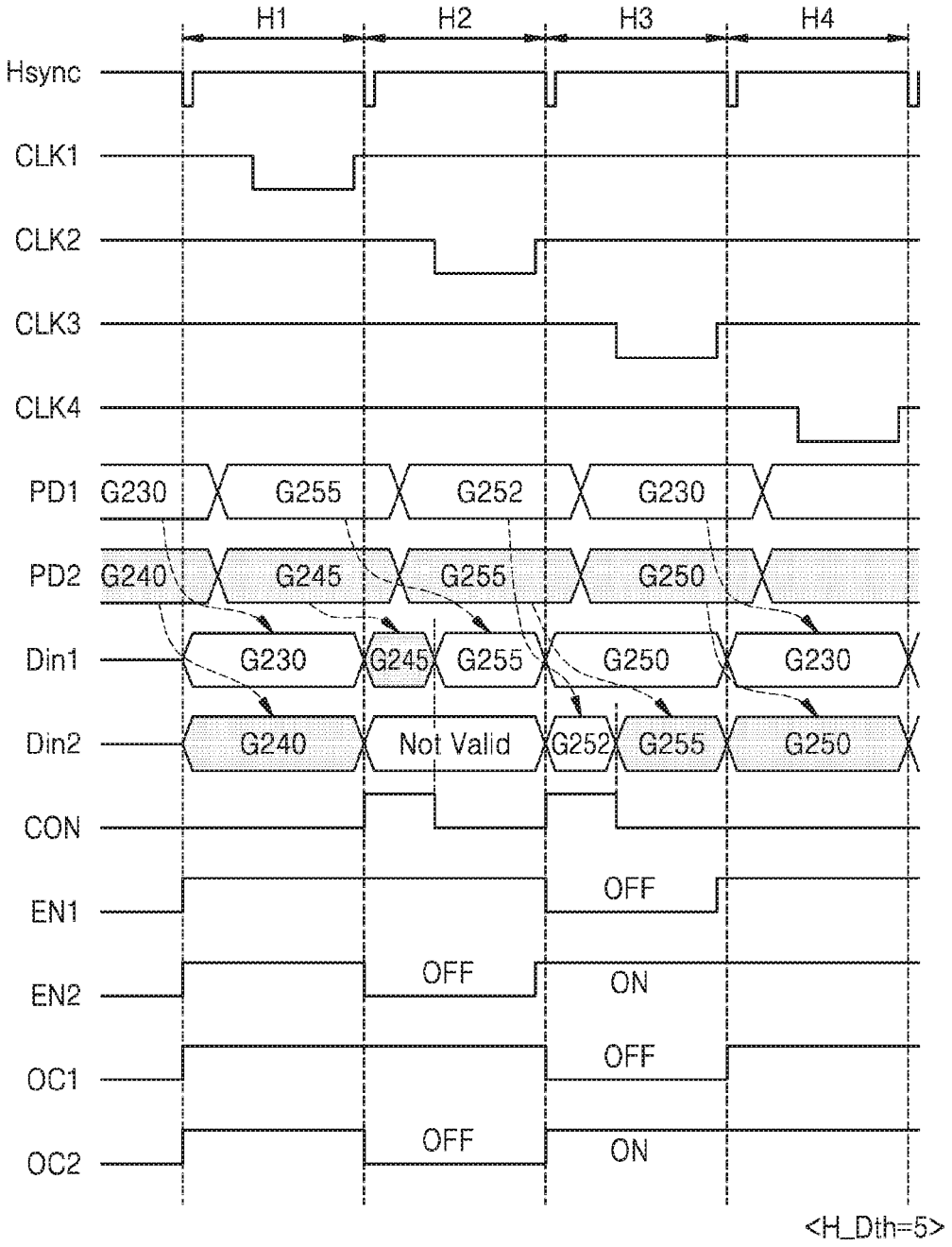
FIG. 10 is a timing diagram illustrating an example of the display driving circuit of FIG. 2.

FIG. 10 is a timing diagram of an example of the display driving circuit 500*a* of FIG. 2.

Referring to FIG. 9, the second amplifier SA2 is turned off, and the first amplifier SA1 is turned on, and thus, the first amplifier SA1 drives two data lines. However, referring to FIG. 10, the second amplifier SA2 is turned off, and the first amplifier SA1 is turned on during the second horizontal driving period H2, while the first amplifier SA1 is turned off, and the second amplifier SA2 is turned on during the third horizontal driving period H3, thereby driving the first data line DL1 and the second data line DL2. One of the first amplifier SA1 and the second amplifier SA2 may be selectively turned on by taking into account the first pixel data PD1, the second pixel data PD2, and transitions of the first pixel data PD1 and the second pixel data PD2.

According to an example embodiment, as illustrated in FIG. 10, when the first pixel data PD1 is the same as or greater than the second pixel data PD2, the first amplifier SA1 is turned on, and when the first pixel data PD1 is smaller than the second pixel data PD2, the second amplifier SA2 may be turned on. However, one or more example embodiments are not limited thereto. The control logic 210*a* (of FIG. 1) may select which amplifier among the first amplifier SA1 and the second amplifier SA2 is to be turned on by taking into account the first pixel data PD1, the second pixel data PD2, and the transition amounts of the first pixel data PD1 and the second pixel data PD2.

When a determination as to whether the first amplifier SA1 and the second amplifier SA2 operate is made, the transition amounts of the pixel data may be taken into account. The operations of the first amplifier SA1 and the second amplifier SA2 will be described with reference to FIG. 11.

Figure 11:
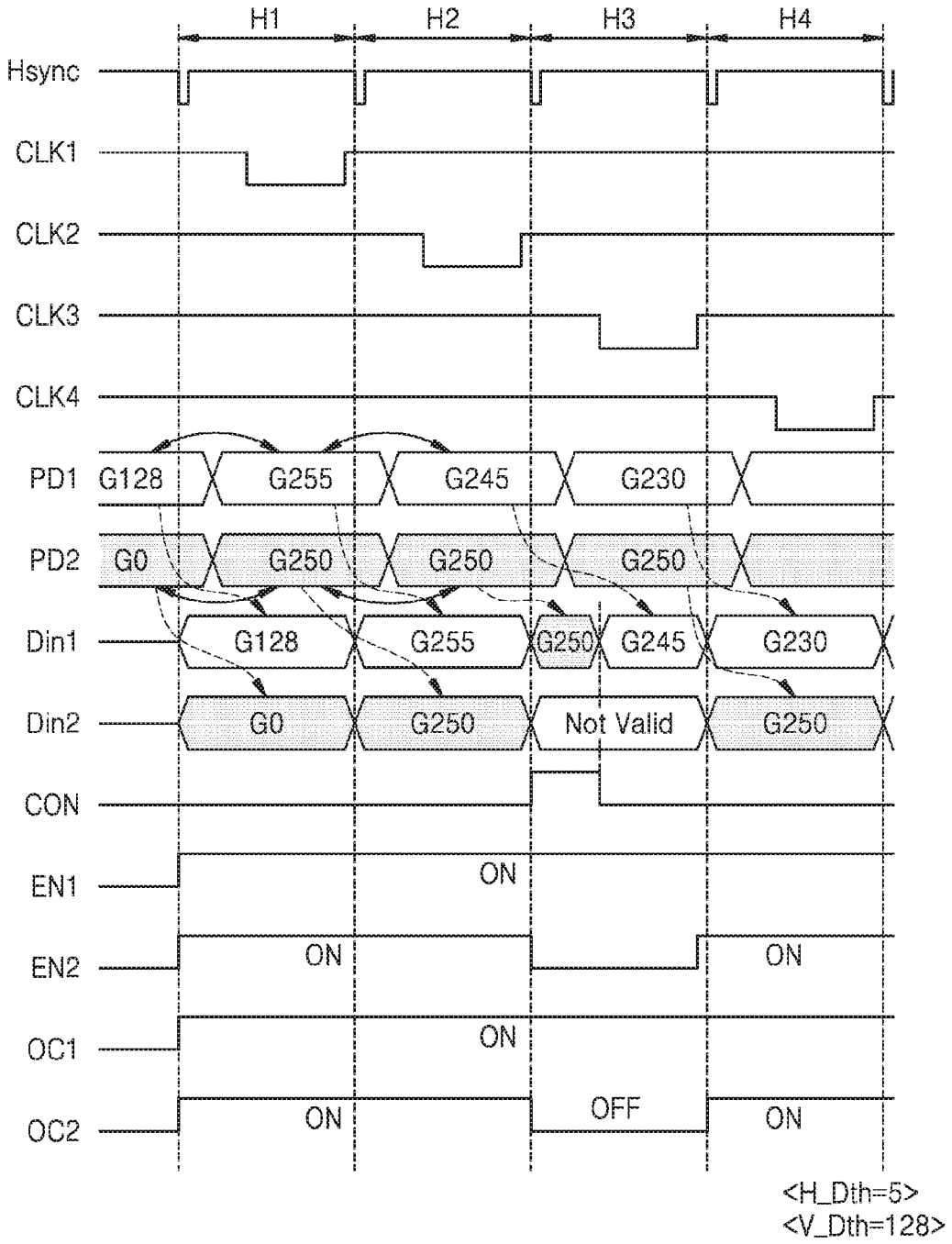
FIG. 11 is a timing diagram illustrating an example of a display driving circuit, according to an example embodiment.

FIG. 11 is a timing diagram illustrating an example of a display driving circuit, according to an example embodiment.

Referring to FIG. 11, when the data difference between the first pixel data PD1 and the second pixel data PD2 is less than or equal to the horizontal threshold value H_Dth, and when the transition amount of the first pixel data PD1 and the transition amount of the second pixel data PD2 are less than the vertical threshold value V_Dth, one of the first amplifier SA1 and the second amplifier SA2 may be turned off, and the other thereof may drive the first data line DL1 and the second data line DL2.

The first pixel data PD1 received during the first horizontal driving period H1 is G255, and the second pixel data PD2 received during the first horizontal driving period H1 is G250. The data difference between the first pixel data PD1 and the second pixel data PD2 is the same as 5 that is the horizontal threshold value H_Dth. The transition amount of the first pixel data PD1 is 127, which is less than 128 that is the vertical threshold value V_Dth. However, the transition amount of the second pixel data PD2 is 250 which is greater than the vertical threshold value V_Dth. Therefore, during the second horizontal driving period H2, the first amplifier SA1 and the second amplifier SA2 may be turned on and may each drive one data line.

The first pixel data PD1 received during the second horizontal driving period H2 is G245, and the second pixel data PD2 received during the second horizontal driving period H2 is G250. The data difference between the first pixel data PD1 and the second pixel data PD2 is the same as the horizontal threshold value H_Dth that is 5. The transition amount of the first pixel data PD1 is 10, which is less than 128 that is vertical threshold value V_Dth. Also, the transition amount of the second pixel data PD2 is 0. Therefore, during the third horizontal driving period H3, one of the first amplifier SA1 and the second amplifier SA2, for example, the first amplifier SA1, may be turned on to drive two data lines, and the second amplifier SA2 may be turned off.

The first pixel data PD1 received during the third horizontal driving period H3 is G230, and the second pixel data PD2 received during the third horizontal driving period H3 is G250. The data difference between the first pixel data PD1 and the second pixel data PD2 is 20 and is greater than the horizontal threshold value H_Dth. Therefore, during the fourth horizontal driving period H4, both the first amplifier SA1 and the second amplifier SA2 may be turned on and may each drive one data line.

As described, when a determination as to whether the control logic 210*a* (of FIG. 2) allows one amplifier to drive two data lines is made, a driving load of the amplifier is reduced, and image quality degradation may be prevented from occurring by taking into account the data difference between the pieces of the pixel data as well as the transition amounts of the pieces of the pixel data.

Figure 12:
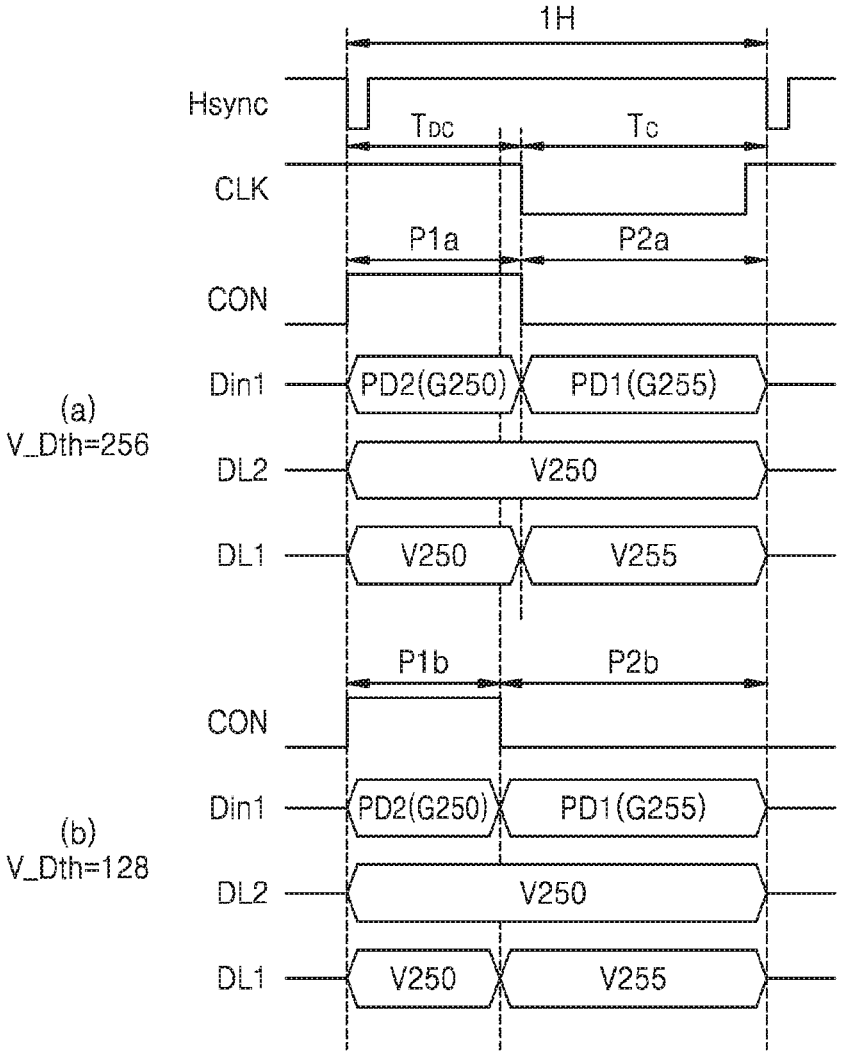
FIG. 12 is a timing diagram illustrating an operation of a display driving circuit according to setting of a vertical threshold value.

FIG. 12 is a timing diagram illustrating an operation of a display driving circuit according to a setting of a vertical threshold value.

FIG. 12 illustrates an example in which first periods P1*a* and P1*b* and second periods P2*a* and P2*b* are set within the horizontal driving period 1H according to a vertical threshold value when one amplifier, e.g., a first amplifier, drives two data lines.

Referring to case (a) of FIG. 12, when the vertical threshold value V_Dth is 256, the first period P1*a* may be set identically with the data charging time TDC. As described above, the data charging time TDC may be set based on a full range transition of data.

Referring to case (b) of FIG. 12, when the vertical threshold value V_Dth is 128, the first period P1*b* is set to be less than the data charging time TDC, and fine driving may start on the first data line within the data charging time TDC.

When the vertical threshold value V_Dth is set to be relatively small, a maximum driving load of one amplifier driving two data lines may decrease, compared to a case where the vertical threshold value V_Dth is set to be relatively great. Therefore, setting the coarse driving time to be small is fine. When the vertical threshold value V_Dth is small, the coarse driving time is set to be less, and thus a start point of the fine driving may be advanced, or the fine driving time may increase.

Figure 13:
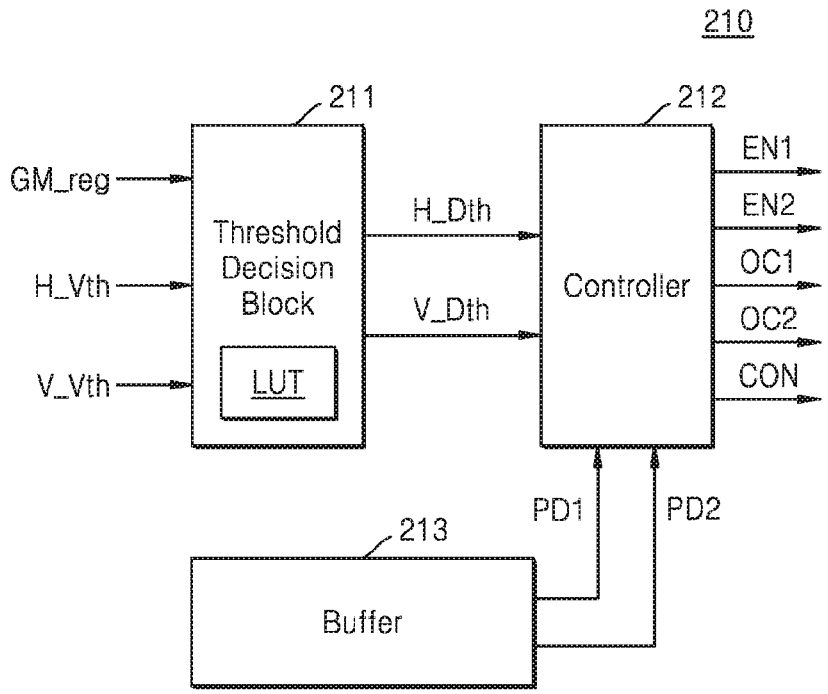
FIG. 13 is a block diagram illustrating an example of a control logic according to an example embodiment.
Figure 14:
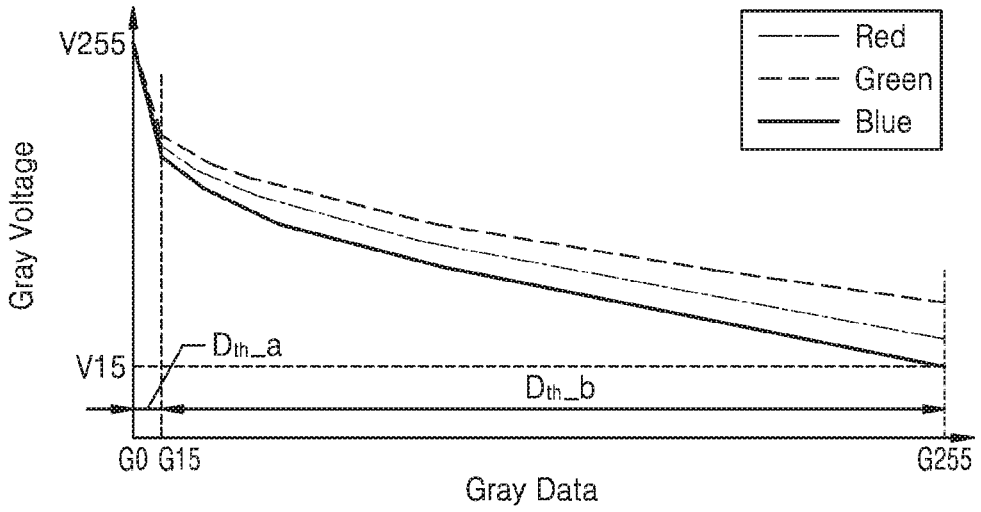
FIG. 14 is a graph illustrating gamma characteristics of an organic light-emitting diode (OLED) panel.

FIG. 13 is a block diagram illustrating an example of a control logic 210 according to an example embodiment. FIG. 14 is a graph illustrating gamma characteristics of an OLED panel.

Referring to FIG. 13, the control logic 210 may include a threshold decision block 211, a controller 212, and a buffer 213.

The control logic 210 may include various processing circuitry such as, but not limited to, a processor, Central Processing Unit (CPU), a controller, an arithmetic logic unit (ALU), a digital signal processor, a microcomputer, a field programmable gate array (FPGA), an Application Specific Integrated Circuit (ASIC), a System-on-Chip (SoC), a programmable logic unit, a microprocessor, or any other device capable of performing operations in a defined manner.

In some example embodiments, the processing circuitry may include discrete circuitry for each of the threshold decision block 211 and the controller 212 such that different processing circuitry is configured, through a layout design or execution of computer readable instructions stored in a memory (not shown), as a special purpose computer to perform the functions of the threshold decision block 211 and the controller 212. In other example embodiments, the processing circuitry associated with the controller 212 may also perform the functions of the threshold decision block 211 such that the same processing circuitry is configured, through a layout design or execution of computer readable instructions stored in a memory (not shown), as a special purpose computer to perform the functions of the threshold decision block 211 and the controller 212.

For example, the processing circuitry may be configured, through a layout design or execution of computer readable instructions stored in a memory (not shown), as a special purpose computer to enable one amplifier to drive two pixels when two pixel data are the same or the data difference between the pieces of the pixel data is less than or equal to the horizontal threshold value, such that the two pixels are driven through coarse driving and fine driving without increasing the horizontal driving period 1H. Therefore the processing circuitry may improve the functioning of the display driving circuit by decreasing the static current consumption without deteriorating image display quality.

The threshold decision block 211 may receive a register setting value GM_reg and a horizontal threshold voltage H_Vth and may set the horizontal threshold value H_Dth based on the gamma register value GM_reg and the horizontal threshold voltage H_Vth. Also, the threshold decision block 211 may further receive a vertical threshold voltage V_Vth and may set the vertical threshold value V_Dth based on the vertical threshold voltage V_Vth. The threshold decision block 211 may set the horizontal threshold value H_Dth for each grayscale and color based on the horizontal threshold voltage H_Vth and the gamma register value GM_reg indicating the gamma characteristics of the display panel 100 (of FIG. 1).

Referring to FIG. 14, the gamma characteristics, that is, a gamma curve, may not linearly increase or decrease, depending on gray data. Since an increase or decrease in the gray voltage according to the increase in the grayscale is not uniform, a difference between gray voltages according to the same grayscale difference is not uniform in each grayscale. Thus, in each grayscale, the threshold decision block 211 may set the horizontal threshold value H_Dth for each grayscale or a grayscale section (or a grayscale area) by taking into account the gamma characteristics so as to make the horizontal threshold value H_Dth uniform. For example, the horizontal threshold value H_Dth in a grayscale of 0 G0 may be less than the horizontal threshold value H_Dth in a grayscale of 255 G255. Also, since the gamma characteristics differ depending on colors, the threshold decision block 211 may set multiple horizontal threshold values H_Dth for each color.

As illustrated, for example, a gradient of a gamma curve in a grayscale of 15 G15 may be greatly changed. The threshold decision block 211 may set a first horizontal threshold value (H_Dth_a) for a first grayscale area Dth_a between the grayscale of 0 G0 to the grayscale of 15 G15, and may set a second horizontal threshold value H_Dth_b for a second grayscale area Dth_b between the grayscale of 15 G15 and the grayscale of 255 G255, by taking into account the horizontal threshold voltage H_Vth. The first horizontal threshold value H_Dth_a may be different from the second horizontal threshold value H_Dth_b.

Similarly, the threshold decision block 211 may set the vertical threshold value V_Dth for each grayscale and each color by taking into account the gamma characteristics to make the vertical threshold value V_Dth uniform. However, one or more example embodiments are not limited thereto. In an example embodiment, the threshold decision block 211 may set one vertical threshold value V_Dth regardless of grayscales and colors.

Referring to FIG. 13, the threshold decision block 211 may include a look-up table LUT, and the horizontal threshold value H_Dth and the vertical threshold value V_Dth, which are set for each grayscale and each color, may be stored in the look-up table LUT.

The buffer 213 may provide the pixel data to the controller 212. For convenience of explanation, it is illustrated that the buffer 213 provides the first pixel data PD1 and the second pixel data PD2 to the controller 212, but one or more example embodiments are not limited thereto. The buffer 213 may sequentially provide the controller 212 with pieces of pixel data respectively corresponding to pixels on one horizontal line. In addition, when the controller 212 compares the pixel data by taking into account the vertical threshold value V_Dth, the buffer 213 may provide the controller 212 with pixel data corresponding to the pixels on one horizontal line and previous pixel data corresponding to pixels on a previous horizontal line. The buffer 213 may store pixel data for one line or two lines. The buffer 213 may be embodied as a line buffer or a memory.

While not illustrated in FIG. 13, the control logic 210 may further include memory. The memory may include at least one of a volatile memory, non-volatile memory, random access memory (RAM), a flash memory, a hard disk drive, and an optical disk drive. For example, the LUT may be stored in a non-volatile memory, and the buffer 213 may be part of a volatile memory.

The controller 212 may generate the control signals based on the pixel data provided by the buffer 213, for example, the first pixel data PD1 and the second pixel data PD2. As described above with reference to FIG. 2, the control signals may include the first and second enable signals EN1 and EN2 determining whether amplifiers operate, the first and second output control signals OC1 and OC2 controlling the output from the amplifiers, and the connection control signal CON.

The controller 212 may generate the control signals based on the first pixel data PD1, the second pixel data PD2, and the horizontal threshold value H_Dth. The controller 212 may calculate a data difference between the first pixel data PD1 and the second pixel data PD2 and may compare the data difference with the horizontal threshold value H_Dth, thus generating the control signals controlling the data driver 300*a* (of FIG. 2) based on comparison results. According to an example embodiment, as described above, the horizontal threshold value H_Dth may be set for each grayscale, and in this case, the controller 212 may compare the data difference with the horizontal threshold value H_Dth corresponding to a grayscale indicated by the first pixel data PD1 or the second pixel data PD2 by referring to the loop-up table LUT of the threshold decision block 211.

According to an example embodiment, the controller 212 may generate the control signals based on the first pixel data PD1, the second pixel data PD2, the horizontal threshold value H_Dth and the vertical threshold value V_Dth. The controller 212 may calculate the first data difference between the first pixel data PD1 and the second pixel data PD2 and may compare a first data difference with the horizontal threshold value H_Dth. The controller 212 may also calculate a second data difference between the first pixel data PD1 and first previous pixel data that is previously received and a third data difference between the second pixel data PD2 and second previous pixel data that is previously received, and may compare the second and third data differences with the vertical threshold value V_Dth. The controller 212 may generate the control signals controlling the data driver 300*a* (of FIG. 2) based on comparison results.

Figure 15:
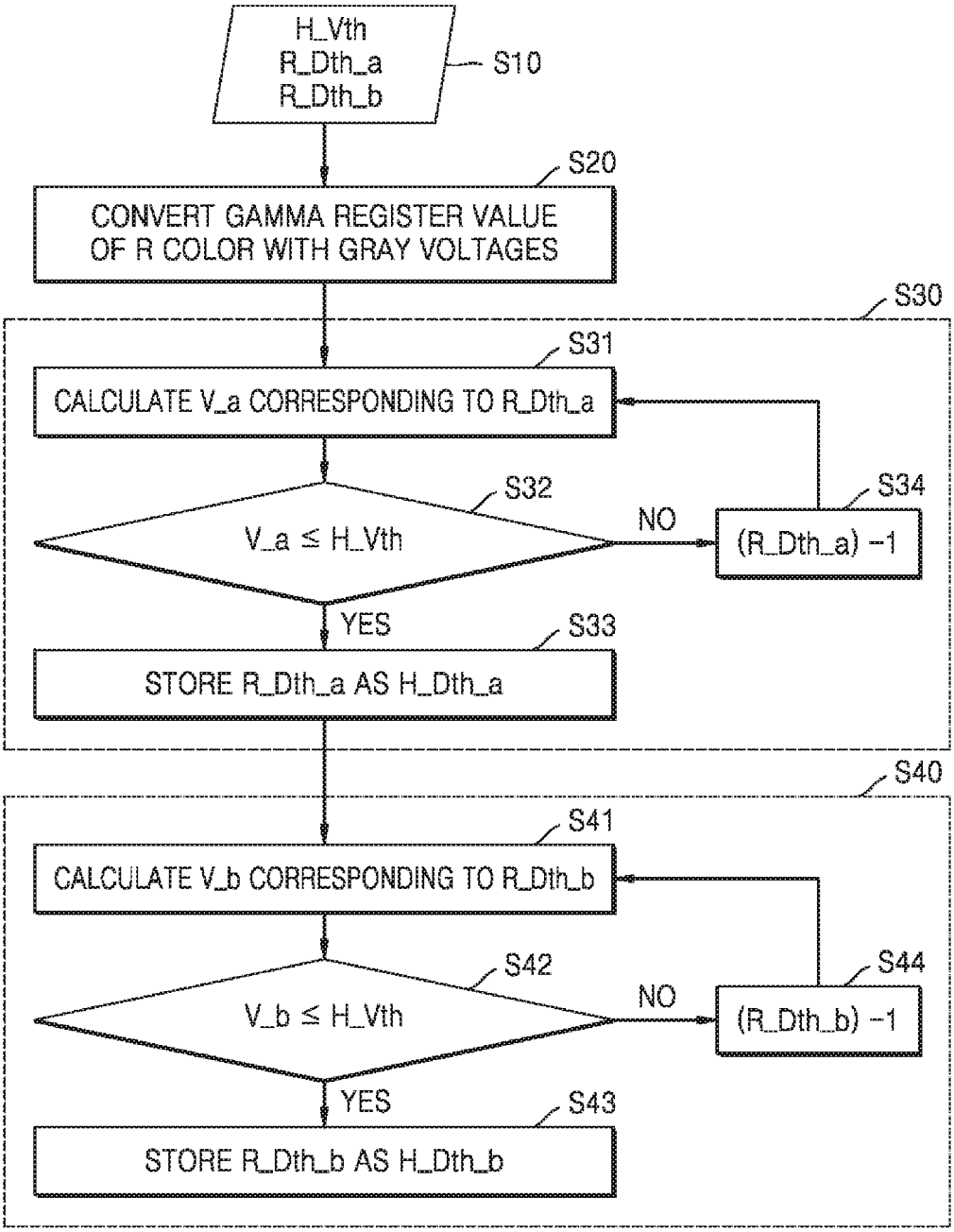
FIG. 15 is a flowchart of a method of operating a threshold determination block of FIG. 13.

FIG. 15 is a flowchart of a method of operating the threshold decision block 211 of FIG. 13. In detail, FIG. 15 is a flowchart of a method in which the threshold decision block 211 sets a horizontal threshold value for each grayscale corresponding to a red color.

Referring to FIG. 15, in operation S10, the threshold decision block 211 (of FIG. 13) may obtain reference threshold data. For example, the reference threshold data may include a horizontal threshold voltage H_Vth, a first reference threshold value R_Dth_a corresponding to a first grayscale area, and a second reference threshold value R_Dth_b corresponding to a second grayscale area. As described above with reference to FIG. 14, a gradient of the gamma curve in the first grayscale area may be different from a gradient of the gamma curve in the second grayscale area. A reference threshold grayscale that is a reference regarding a rapidly changing gradient may be further set.

According to an example embodiment, in operation S20, the threshold decision block 211 may convert a gamma register value regarding a red color into a gray voltage regarding a red color and may output a gamma characteristic regarding a red color based on the gray voltage. The threshold decision block 211 may set reference threshold values based on the gamma characteristic. According to an example embodiment, the reference threshold data may be provided by an external device, e.g., a host processor.

Then, in operation S30, the threshold decision block 211 may set the horizontal threshold value for each grayscale in the first grayscale area based on operations S31-S34.

For example, in operation S31, the threshold decision block 211 may calculate a gray voltage V_a corresponding to the first reference threshold value R_Dth_a from each grayscale included in the first grayscale area. Further, the threshold decision block 211 may compare the gray voltage V_a with the horizontal threshold voltage H_Vth. In operation S33, when the gray voltage V_a is less than or equal to the horizontal threshold voltage H_Vth, the first reference threshold value R_Dth_a may be stored as a horizontal threshold value H_Dth_a of a corresponding grayscale of the first grayscale area. In operation S34, when the gray voltage V_a is greater than the horizontal threshold voltage H_Vth, the threshold decision block 211 may subtract 1 (a 1-bit data value) from the first reference threshold value R_Dth_a. Then, based on a first reference threshold value R_Dth_a that is newly set, operation S31 may be performed again, and operations S31, S32, and S34 may be repeatedly performed until a gray voltage V_a corresponding to the first reference threshold value R_Dth_a that is newly set becomes less than or equal to the horizontal threshold voltage H_Vth.

In operation S40, the threshold decision block 211 may set the horizontal threshold value for each grayscale in the second grayscale area based on operations S41-S44.

For example, in operation S41, a gray voltage V_b corresponding to the second reference threshold value R_Dth_b may be calculated from each grayscale included in the second grayscale area, and the gray voltage V_b may be compared with the horizontal threshold voltage H_Vth in operation S42. In operation S43, when the gray voltage V_b is less than or equal to the horizontal threshold voltage H_Vth, the second reference threshold value R_Dth_b may be stored as a horizontal threshold value H_Dth_b of a corresponding grayscale of the second grayscale area. In operation S44, when the gray voltage V_b is greater than the horizontal threshold voltage H_Vth, 1 (a 1-bit data value) may be subtracted from the second reference threshold value R_Dth_b. Then, based on a second reference threshold value R_Dth_b that is newly set, operation S41 may be performed again, and operations S41, S42, and S44 may be repeatedly performed until a gray voltage V_b corresponding to the second reference threshold value R_Dth_b that is newly set becomes less than or equal to the threshold voltage H_Vth.

The threshold decision block 211 may perform operation S30 on each grayscale in the first grayscale area, and perform operation S40 on each grayscale in the second grayscale area. Thus, the horizontal threshold value H_Dth for each grayscale regarding a red color may be set.

The threshold decision block 211 may set the horizontal threshold value H_Dth for each grayscale regarding another color, e.g., a blue color, a green color, or the like.

Figure 16:
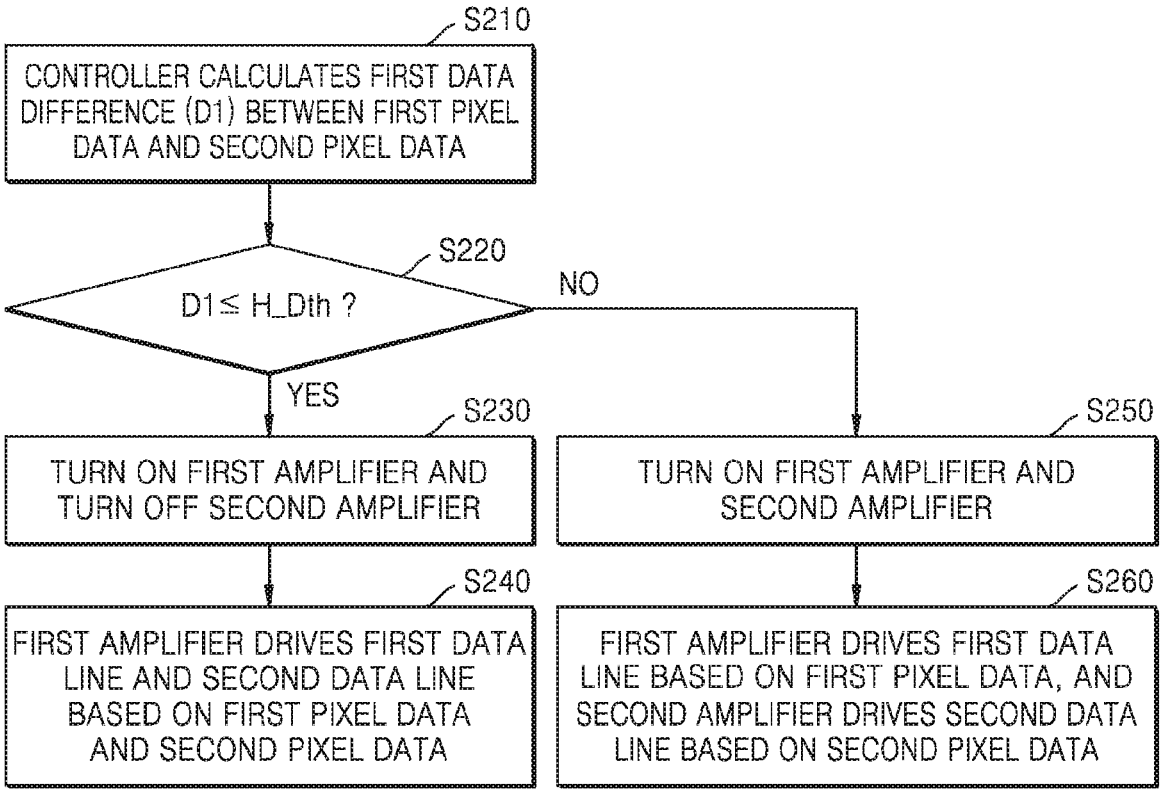
FIG. 16 is a flowchart of a method of operating a display driving circuit, according to an example embodiment.

FIG. 16 is a flowchart of a method of operating a display driving circuit, according to an example embodiment.

Referring to FIG. 16, the controller 212 (see FIG. 13) may calculate a first data difference D1 between the first pixel data and the second pixel data, in operation S210. The first pixel data and the second pixel data may be on the same horizontal line and respectively correspond to two pixels having the same color.

In operation S220, the controller 212 may compare the first data difference D1 with the horizontal threshold value H_Dth.

In operation S230, when the first data difference D1 is less than or equal to the horizontal threshold value H_Dth, the controller 212 may turn on the first amplifier and turn off the second amplifier. In operation S240, the first amplifier that is turned on may drive the first data line and the second data line based on the first pixel data and the second pixel data. The second amplifier may coarse-drive the first data line and the second data line based on the second pixel data and then may fine-drive the first data line based on the first pixel data.

In operation S250, when the first data difference D1 is greater than the horizontal threshold value H_Dth, the controller 212 may turn on the first amplifier and the second amplifier. In operation S260, the first amplifier and the second amplifier may drive the first data line and the second data line, respectively. The first amplifier may drive the first data line based on the first pixel data, and second amplifier may drive the second data line based on the second pixel data.

Figure 17:
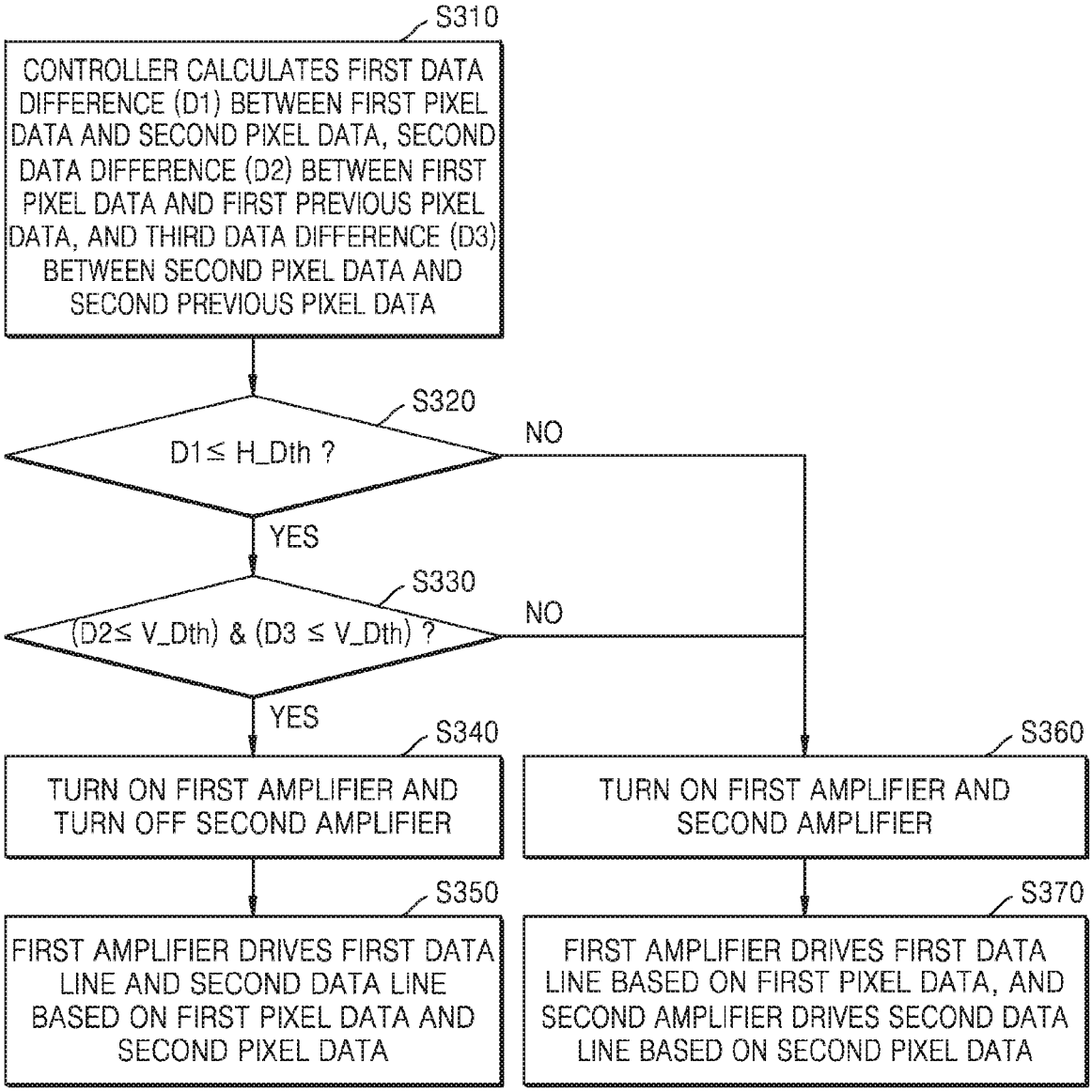
FIG. 17 is a flowchart of a method of operating a display driving circuit, according to an example embodiment.

FIG. 17 is a flowchart of a method of operating a display driving circuit, according to an example embodiment.

Referring to FIG. 17, in operation S310, the controller 212 (see FIG. 13) may calculate the first data difference D1 between the first pixel data and the second pixel data, which are on the same horizontal line and respectively correspond to two pixels having the same color, the second data difference D2 between the first pixel data and the first previous pixel data, and a third data difference D3 between the second pixel data and second previous pixel data. The second data difference D2 indicates the transition amount of the first pixel data, and the third data difference D3 indicates the transition amount of the second pixel data.

In operation S320, the controller 212 may compare the first data difference D1 with the horizontal threshold value H_Dth. In operation S330, when the first data difference D1 is less than or equal to the horizontal threshold value H_Dth, the controller 212 may compare each of the second data difference D2 and the third data difference D3 with the vertical threshold value V_Dth. In operation S340, when both the second data difference D2 and the third data difference D3 are less than or equal to the vertical threshold value V_Dth, the controller 212 may turn on the first amplifier and turn off the second amplifier. In operation S350, the first amplifier that is turned on may drive the first data line and the second data line based on the first pixel data and the second pixel data.

In operation S360, when the first data difference D1 is greater than the horizontal threshold value H_Dth, or when at least one of the second data difference D2 and the third data difference D3 is greater than the vertical threshold value V_Dth, the above conditions may be load conditions in which one amplifier may not drive two data lines. In operation S360, the controller 212 may turn on the first amplifier and the second amplifier. In operation S370, the first amplifier and the second amplifier may drive the first data line and the second data line, respectively. The first amplifier may drive the first data line based on the first pixel data, and second amplifier may drive the second data line based on the second pixel data.

Figure 18:
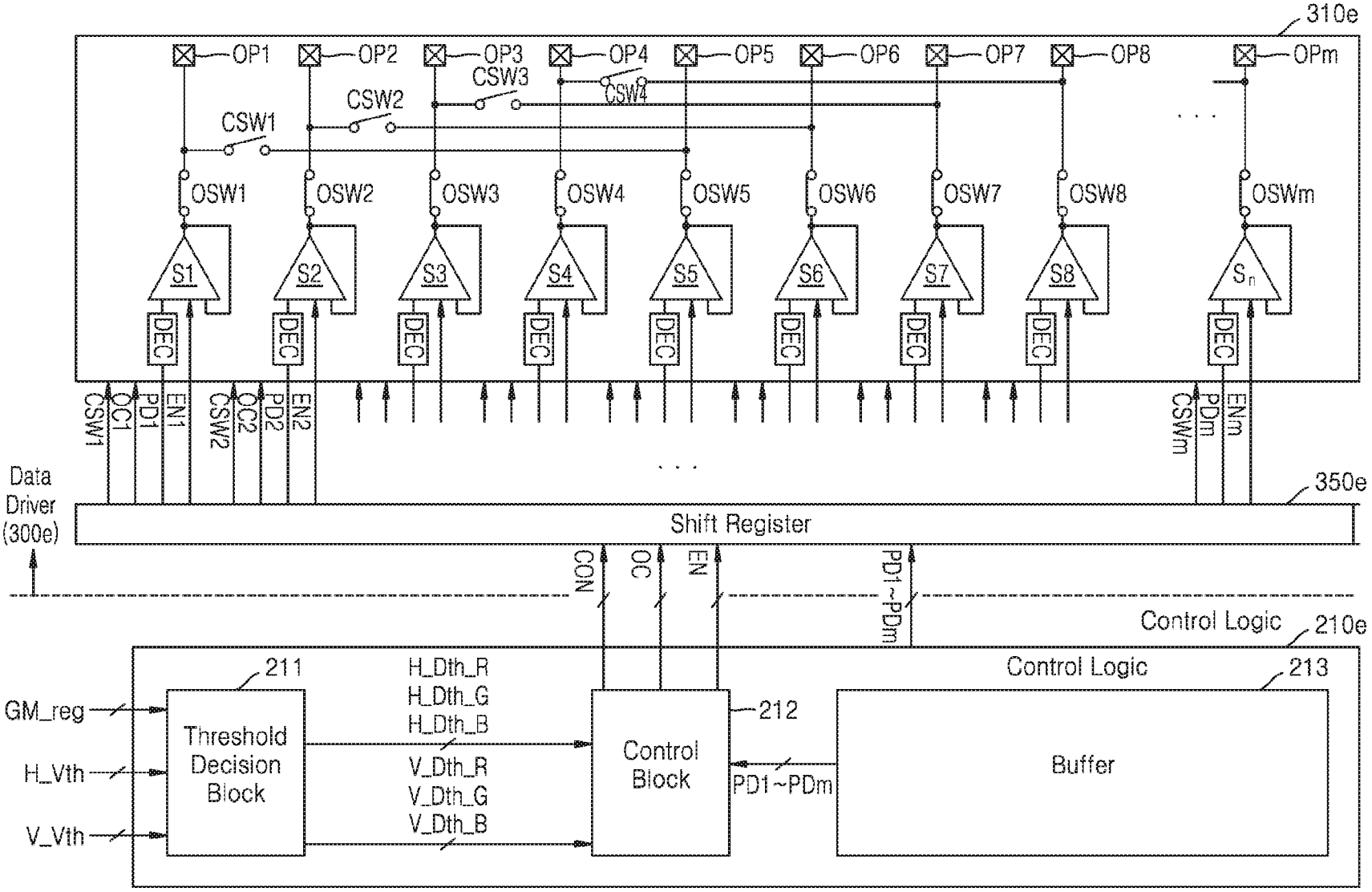
FIG. 18 is a block diagram of a display driving circuit according to an example embodiment.
Figure 19:
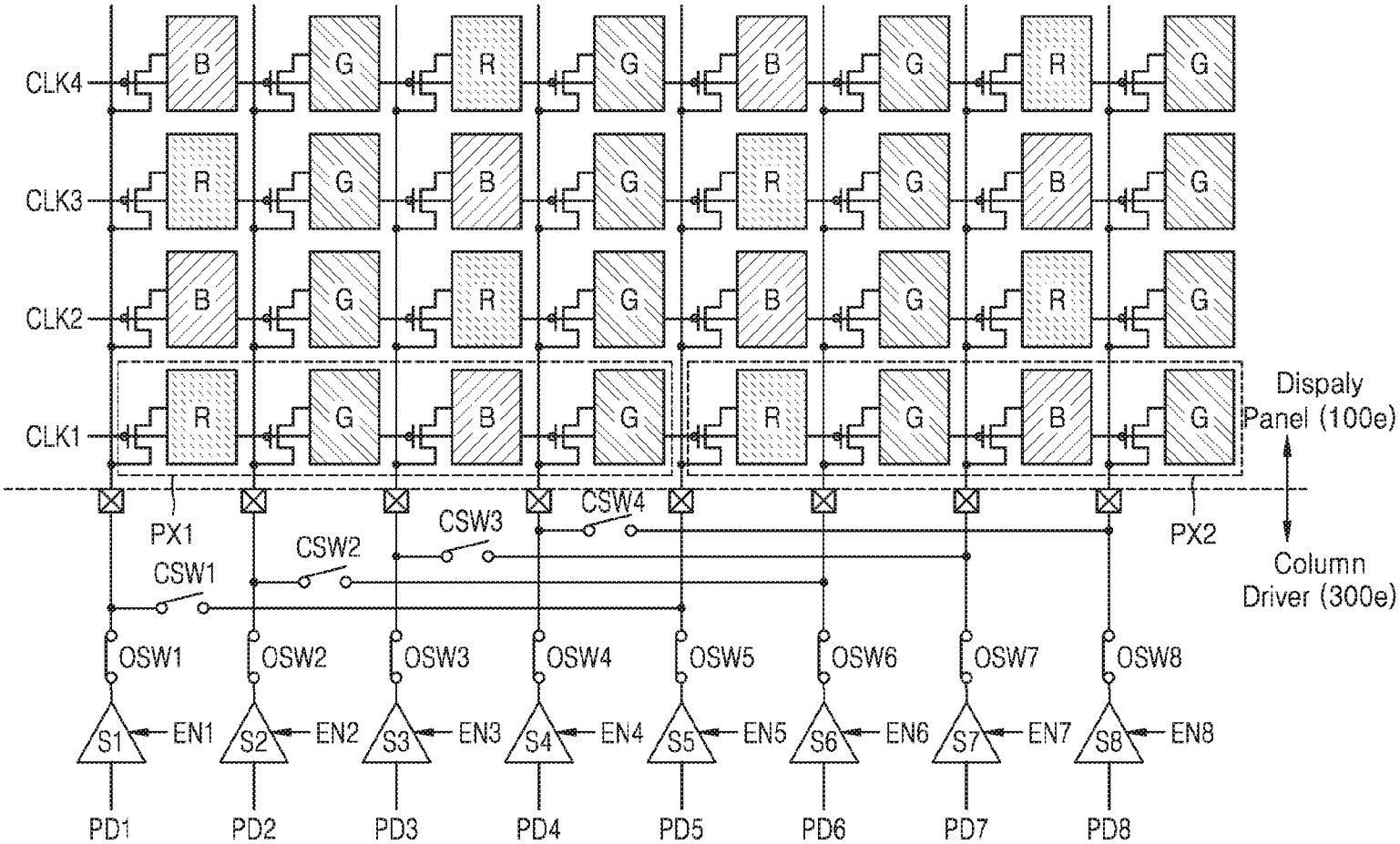
FIG. 19 illustrates an example of a data driver and a display panel having a pentile structure, according to an example embodiment.

FIG. 18 is a block diagram of a display driving circuit according to an example embodiment. FIG. 19 illustrates an example of a data driver and a display panel having a pentile structure, according to an example embodiment. FIG. 18 is a block diagram for explaining the control logic 210 and the data driver 300 of the display apparatus 1000 of FIG. 1 in more detail, and thus the descriptions provided with reference to FIG. 1 may be applied to the present embodiment.

Referring to FIG. 18, the display driving circuit may include a control logic 210*e* and a data driver 300*e*. The display driving circuit may further include the components illustrated in FIG. 1.

The control logic 210*e* may include the threshold decision block 211, the controller 212, and the buffer 213. The descriptions of the control logic 210 of FIG. 13 may be applied to the control logic 210*e* of FIG. 18.

The threshold decision block 211 may set horizontal threshold values and vertical threshold values corresponding to respective colors, based on the gamma register value GM_reg, horizontal threshold voltage H_Vth, and the vertical threshold voltage V_Vth. For example, the threshold decision block 211 may set horizontal threshold values H_Dth_R, H_Dth_G, and H_Dth_B and vertical threshold values V_Dth_R, V_Dth_G, and V_Dth_B corresponding to red, green, and blue, respectively.

The buffer 213 may store and output the first pixel data PD1 to mth pixel data PDm for one line or pieces of the pixel data for two lines. The buffer 213 may provide the first pixel data PD1 to mth pixel data PDm to the controller 212 as well as a shift register 350*e* of the data driver 300*e*. The buffer 213 may be embodied as a line buffer, a memory, or the like. According to an example embodiment, when the display driving circuit includes a graphic memory in which image data of one frame is stored, the graphic memory may be driven as the buffer 213.

The controller 212 may analyze the first pixel data PD1 to mth pixel data PDm, which are provided by the buffer 213 based on the horizontal threshold values H_Dth_R, H_Dth_G, and H_Dth_B and the vertical threshold values V_Dth_R, V_Dth_G, and V_Dth_B corresponding to red, green, and blue, respectively, and may generate control signals based on analysis results. The control signals may include enable signals EN, output control signals CO, and connection control signals CON respectively provided to the first to mth amplifiers SA1 to SAm.

The data driver 300*e* may include a driving circuit (310*e*) including first to nth amplifiers S1 to Sn and a plurality of switches (for example, first to fourth connection switches CSW1 to CSW4 and first to mth output switches OSW1 to OSWm), and a shift register 350*e*. Similar to the data drivers 300*b* and 300*c* illustrated in FIGS. 7A and 8A, the data driver 300*e* may further include an input switching circuit.

The shift register 350*e* may sequentially receive, from the control logic 210*e*, the first pixel data PD1 to mth pixel data PDm for one line, the enable signals EN, the output control signals OC, and the connection control signals CON, and may provide the amplifying circuit 310*e* with the first pixel data PD1 to mth pixel data PDm for one line and the enable signals EN in response to horizontal synchronization signals and timing signals, thus providing the output control signals OC and the connection control signals CON to the plurality of switches. According to the one or more example embodiments, each of the amplifiers (e.g., first to nth amplifiers S1 to Sn) may drive each pixel of the display panel, or one amplifier may drive two pixels of the display panel.

For example, as illustrated in FIG. 19, the data driver 300*e* may drive the display panel having a pentile structure. As a non-limiting example embodiment, in the display panel having a pentile structure, a red sub-pixel, a first green sub-pixel, a blue sub-pixel, and a second green sub-pixel, which are on the same horizontal line and sequentially arranged, may form one pixel (e.g., the first pixel PX1, the second pixel PX2, or the like). For example, the first to fourth amplifiers S1 to S4 of the amplifying circuit 310*e* may drive a red sub-pixel, a first green sub-pixel, a blue sub-pixel, and a second green sub-pixel of the first pixel PX1, and the fifth to eighth amplifiers S5 to S8 may drive a red sub-pixel, a first green sub-pixel, a blue sub-pixel, and a second green sub-pixel of the second pixel PX2 adjacent to the first pixel PX1. When a data difference between the red sub-pixels included in the first pixel PX1 and the second pixel PX2 is less than or equal to a horizontal threshold value H_Dth_R corresponding to a red color, the fifth amplifier S5 may be turned off, and the first amplifier S1 may drive the red sub-pixels of the first pixel PX1 and the second pixel PX2 during one horizontal driving period. According to an example embodiment, as described above with reference to FIG. 11, the fifth amplifier S5 may be turned on or off by taking into account a transition amount of the pixel data corresponding to the red sub-pixel of the first pixel PX1 and a transition amount of the pixel data corresponding to the red sub-pixel of the second pixel PX2.

Amplifiers driving sub-pixels included in the same pixel, for example, the first to fourth amplifiers S1 to S4, may collectively or individually operate. For example, the first to fourth amplifiers S1 to S4 may operate in response to the same enable signal or different enable signals.

When the first to fourth amplifiers S1 to S4 collectively operate, the fifth to eighth amplifiers S5 to S8 and first to fourth connection switches CSW1 to CSW4 may also collectively operate. When the data difference between the red sub-pixels of the first pixel PX1 and the second pixel PX2, a data difference between the first green sub-pixels, a data difference between the blue sub-pixels, and a data difference between the second green sub-pixels are each be less than or equal to the horizontal threshold value (e.g., the horizontal threshold value corresponding to each color), the fifth to eighth amplifiers S5 to S8 may be turned off, and the first to fourth amplifiers S1 to S4 may be turned on. Each of the first to fourth amplifiers S1 to S4 that are turned on may drive sub-pixels of a corresponding color among the sub-pixels of the first pixel PX1 and the second pixel PX2, as described above with reference to FIGS. 4A to 5.

However, one or more example embodiments are not limited thereto, and according to another example embodiment, amplifiers connected to the same pixel may individually operate according to data of the sub-pixels of corresponding colors. For example, the first and fifth amplifiers S1 and S5 may operate according to the data difference between the red sub-pixels, and the second and sixth amplifiers S2 and S6 may operate according to the data difference between the first green sub-pixels. In addition, the third and seventh amplifiers S3 and S7 and the fourth and eighth amplifiers S4 and S8 may operate according to the data difference between corresponding sub-pixels.

While example embodiments of the inventive concepts has been particularly shown and described with reference to some example embodiments thereof, it will be understood that various changes in form and details may be made therein without departing from the spirit and scope of the following claims.

What is claimed is:

1. A display driving circuit comprising:
- a first amplifier configured to drive a first data line of a display panel based on first pixel data; and
- a second amplifier configured to drive a second data line of the display panel based on second pixel data,
  - wherein the second amplifier is disabled and the first amplifier is enabled such that the first amplifier is configured to drive the first data line and the second data line based on the first pixel data and the second pixel data, in response to the first pixel data being different from the second pixel data and a first data difference between the first pixel data and the second pixel data is less than or equal to a first threshold value.

2. The display driving circuit of claim 1, wherein the first amplifier is configured to,
- drive the first data line and the second data line based on the second pixel data during a first sub-period of a horizontal driving period, and
- drive the first data line based on the first pixel data during a second sub-period of the horizontal driving period.

3. The display driving circuit of claim 2, further comprising:
- a first output pad connected to the first data line;
- a second output pad connected to the second data line; and
- a connection switch connected to the first output pad and the second output pad, the display driving circuit configured to generate a control signal to turn on the connection switch during the first sub-period, and turn off the connection switch during the second sub-period.

4. The display driving circuit of claim 2, further comprising:
- a first decoder configured to output a first gray voltage selected from among a plurality of gray voltages, based on the first pixel data;
- a second decoder configured to output a second gray voltage selected from among the plurality of gray voltages, based on the second pixel data; and
- an input switching circuit configured to,
  - supply the first amplifier with the second gray voltage during the first sub-period in response to a control signal, and
  - supply the first amplifier with the first gray voltage during the second sub-period in response to the control signal.

5. The display driving circuit of claim 2, further comprising:
- a first decoder configured to select one of a plurality of gray voltages as a first gray voltage based on received first input data, and to provide the first gray voltage to the first amplifier; and
- a second decoder configured to select one of the plurality of gray voltages as a second gray voltage based on received second input data, and to provide the second gray voltage to the second amplifier.

6. The display driving circuit of claim 1, further comprising:
- a controller configured to,
  - compare the first data difference with the first threshold value to generate a comparison result, and
  - generate a second enable signal and a control signal based on the comparison result, the second enable signal selectively enabling the second amplifier, and the control signal controlling an output path of the first amplifier.

7. The display driving circuit of claim 6, wherein the controller is configured to calculate a plurality of first threshold values for each grayscale based on a first threshold voltage and a gamma register value.

8. The display driving circuit of claim 7, wherein the controller is further configured to,
- store the plurality of first threshold values in a look-up table, and
- determine whether the second amplifier amplifies a data value of the first pixel data or the second pixel data based on a first threshold value, the first threshold value being selected from among the plurality of first threshold values.

9. The display driving circuit of claim 1, wherein
- the first pixel data corresponds to a first pixel connected to a $K^{th}$ scan line and the first data line of the display panel, K being an integer greater than or equal to 2,
- the second pixel data corresponds to a second pixel connected to the $K^{th}$ scan line and the second data line, and
- when at least one of (i) a second data difference between the first pixel data and first previous pixel data, which corresponds to a third pixel connected to a $(K-1)^{th}$ scan line and the first data line, and (ii) a third data difference between the second pixel data and second previous pixel data, which corresponds to a fourth pixel connected to the $(K-1)^{th}$ scan line and the second data line, is greater than a second threshold value, then, during a $K^{th}$ horizontal driving period, the first amplifier is configured to drive the first data line based on the first pixel data, and the second amplifier is configured to drive the second data line based on the second pixel data.

10. The display driving circuit of claim 9, wherein the display driving circuit is configured to, when the first data difference is less than or equal to the first threshold value and the second data difference and the third data difference are less than or equal to the second threshold value, disable the second amplifier, and enable the first amplifier to drive the first data line and the second data line during a first period of a horizontal driving period, and to drive the first data line during a second period of the horizontal driving period; and set a length of the first period such that the length of the first period decreases when the second threshold value decreases.

11. The display driving circuit of claim 9, further comprising: a controller configured to, compare the first data difference with the first threshold value;

compare each of the second data difference and the third data difference individually with the second threshold value to generate comparison results; and generate a second enable signal and a control signal based on the comparison results, the second enable signal selectively enabling the second amplifier, and the control signal controlling an output path of the first amplifier.

12. The display driving circuit of claim 1, wherein the first data line and the second data line are connected to adjacent pixels that have a same color.

13. The display driving circuit of claim 1, wherein the display panel comprises:

a plurality of organic light-emitting diode (OLED) pixels.

14. A display driving circuit comprising:

a first amplifier configured to drive a first data line of a display panel based on first pixel data;

a second amplifier configured to drive a second data line of the display panel based on second pixel data; and a controller configured to, in a low-power operation mode, receive the first pixel data and the second pixel data during a first horizontal driving period, and in response to the first pixel data associated with the first horizontal driving period being different from the second pixel data associated with the first horizontal driving period and a first data difference between the first pixel data and the second pixel data being less than or equal to a horizontal threshold value N, N being a positive integer, enable a first one of the first amplifier and the second amplifier and disable a second one of the first amplifier and the second amplifier during a second horizontal driving period such that, during the second horizontal driving period, the first one of the first amplifier and the second amplifier is configured to, drive the first data line and the second data line based on the second pixel data during a first period within the second horizontal driving period, and drive the first data line based on the first pixel data during a second period within the second horizontal driving period, the first horizontal driving period and the second horizontal driving period being single consecutive horizontal driving periods of the display panel.

15. The display driving circuit of claim 14, wherein the first pixel data and the second pixel data correspond to $K^{th}$ pixels of the first data line and the second data line, respectively, that are driven during the second horizontal driving period, and the controller is configured to enable one of the first amplifier and the second amplifier based on data values of the first pixel data, the second pixel data, third pixel data corresponding to a $(K-1)^{th}$ pixel of the first data line, and fourth pixel data corresponding to a $(K-1)^{th}$ pixel of the second data line.

16. The display driving circuit of claim 15, wherein the controller is further configured to enable the first amplifier, in response to (i) the first pixel data and the second pixel data being greater than the third pixel data and the fourth pixel data, respectively and (ii) the third pixel data being less than the fourth pixel data.

* * * * *